United States Patent [19]

Matsuoka

[11] Patent Number: 5,025,648

[45] Date of Patent: Jun. 25, 1991

[54] COILED SPRING MAKING APPARATUS

[75] Inventor: Takeji Matsuoka, Tokyo, Japan

[73] Assignee: MEC Machinery Co., Ltd., Tokyo, Japan

[21] Appl. No.: 515,849

[22] Filed: Apr. 27, 1990

[30] Foreign Application Priority Data

May 8, 1989 [JP] Japan ..... 1-113777

[51] Int. Cl.[5] ..... B21F 35/02

[52] U.S. Cl. ..... 72/134; 72/137

[58] Field of Search ..... 72/137, 130, 134; 140/103; 29/564.5, 564, 564.1, 336

[56] References Cited

U.S. PATENT DOCUMENTS 3,349,473 10/1967 Cucuel ..... 29/564
3,698,062 10/1972 LaValle ..... 29/564.1
4,542,635 9/1985 Matsuoka ..... 140/103

*Primary Examiner*—Lowell A. Larson
*Assistant Examiner*—Michael J. McKeon
*Attorney, Agent, or Firm*—Oblon, Spivak, McClelland, Maier & Neustadt

[57] ABSTRACT

A coiled spring making apparatus is provided, including a coiling section for forming coiled springs and a progressive forming section for progressively feeding the coiled springs formed at the coiling section to a plurality of stages on which the coiled springs are held and successively formed into the desired shape. The coiling section is of a bending die system of coiling section at which the coiled springs are formed with their axes kept vertical, and is mounted on a movable table which is movable to any position horizontally or transversely with respect to the progressive forming section and fixed there.

4 Claims, 35 Drawing Sheets

COILED SPRING MAKING APPARATUS

BACKGROUND OF THE INVENTION

1. Field of the Invention

The present invention relates to an apparatus for making coiled springs.

2. Statement of the Prior Art

Conventional coiled spring making apparatuses rely upon one of two basic systems for forming coiled portions.

According to one system called the core shaft type system, a wire is held around a core shaft including lugs thereon, which is then turned simultaneously with its axial movement to wind up the wire in a close- or pitch-coiled manner, and arms extending from both ends of the coiled portion are formed by a tool at the forming section, followed by winding-off into the coiled spring product.

According to another system referred to as the bending die system, feed rollers with a wire held therebetween are rotated to continuously feed out the wire through a wire guide and force it upon a bending die for coiling to form the coiled spring product. Alternatively, before or after that, the wire is intermittently fed out to form an arm or arms extending from one or both ends of the coiled portion by a tool at the forming section, thereby making the coiled spring products.

Most of conventional coiled spring making apparatuses substantially follow such basic systems. In general, however, the ends of coiled springs are processed into desired shapes at a forming section arranged in such a form as surrounding a coiling section before and/or after the forming of the coiled portions. In recent years, coiled spring making apparatuses numerically controlled in various forms have been developed and are now prevailing as main installations throughout the industry. Currently available are, for instance, an apparatus with built-in single spindle numerical controls wherein only the driving of a core shaft is numerically controlled to allow it to follow and synchronize with the driving of a conventional mechanical type of forming section at high speeds, an apparatus wherein the driving of a core shaft and a pitching mechanism are numerically controlled by two spindles for operative association with a pneumatic or hydraulic program sequence system of forming section, an apparatus wherein the driving of feed rollers and the driving of a main shaft to rotate several types of specific cams at the same time and angle for the actuation of several types of tools at a forming section are numerically controlled by two spindles, an apparatus wherein the driving of feed rollers and the operation of main tools at a forming section are numerically controlled by five or six spindles at the same time, and so on.

Of such several types of coiled spring making apparatuses apparatus, the core shaft system of the coiled spring making apparatus can operate at twice to triple the production rate of the bending die system of the apparatus, partly because arm forming can be carried out after a wire has been positively wound around the core shaft and partly because various forming tools can be mechanically operated at considerably high speeds and in an assured manner since dimensional accuracy during forming can be determined in consideration of their sizes and disposition. The former apparatus have an additional advantage of being inexpensive. However, the core shaft system of the coiled spring making apparatus involves the following problems. When both arms are to be formed, not only are much time and skill required for preparatory steps including the determination of the disposition and timing of actuation of forming tools and the selection and regulation of cams to actuate them but, in most cases, visual inspection is also needed for the whole pieces after forming, since to pick up a wire in a stable manner tends to be insecure for reason that lugs provided on the core shaft to hold the wire can be easily wearable. In addition, the diameter of a coiled portion obtained by winding the wire around the core shaft, followed by winding-off, tends to be unstable in terms of dimensional accuracy, since it is in an enlarged state where there are variations in the amount of springing back due to the properties of the starting wire (variations in its tensile strength and its own peculiarities). Moreover, it is impossible to control the orthogonal angles of both arms attached to coiled springs.

On the other hand, the bending die system of the coiled spring making apparatus have the following merits. Since forming is carried out with a wire successively fed out of one end, how to operate at the respective steps is easy to understand and most tools and cams of the forming section can be standardized. Moreover, it is possible to control the orthogonal angles of both arms extending from both ends of a coiled spring. Thus, a short length of time and some skillfulness are only needed for preparatory steps and selection, so that even a technician having an elementary knowledge can well operate such apparatus. Unlike the aforesaid core shaft system, it is further possible to form tension or torsion coiled springs of various geometries. (It is here understood that some tension coiled springs may be produced even by the core shaft system). However, this system has the following productivity and cost problems. The production rate of coiled springs drops considerably because of its relying upon the step of feeding a wire successively out of one end through the predetermined length, which is to be intermittently interrupted, and having a need of synchronizing a double spindle servomotor. In addition, when a second arm is to be formed after the coiled portion of a coiled spring has been formed, it is inevitably required that the coiled portion be swung by a tool at the forming section only through an angle at which that arm is to be formed. Thus, because of fears that the reference point of load of the coiled spring may depart from the specified tolerance and the angle of bending of the second arm to be formed may be unstable, the production rate of coiled springs need to be lowered. Such production rate should also be brought down for another reason that it is required to set torque at a relatively high level, since the load upon the servomotor suffers from a large change from zero to a high due to primary operations of bending wires directly and sharply, thus making the synchronism of two-spindle numerical control unstable in view of the driving characteristics of the servomotor. Such drawbacks are added by high price of the apparatus.

Thus, the conventional apparatus for making coiled springs have both advantages and disadvantages, and the coiled spring making industry now does not only suffer chronically from expert storage but is also increasingly required to supply a variety of articles made on an experimental basis to cope with diverse aspects of society. In urgent need is, therefore, the achievement of a coiled spring making system which can cope with producing a greater variety of coiled spring products in small quantities at reduced costs of production, while making it possible to make coiled springs at higher rates with rapid preparatory arrangements but with no need of skilled hands.

In order to cope with such problems as mentioned above, an object of the present invention is to provide a coiled spring making apparatus in which:

a coiling section is disposed adjacent to a forming section to process a terminating end of a coiled spring, thereby performing the forming of the coiled spring at the coiling section and the forming of the terminating end and/or an arm of the coiled spring at the same time and in parallel.

The forming section being operable to grip the coiled spring formed at the coiling section just after forming and progressively feeding the coiled spring, as gripped, to a plurality of stages where it is progressively formed into a completed coiled spring product.

More specifically, while forming the coiled spring at the coiling section, the coiled spring is formed at the progressive forming section disposed adjacent to the coiling section at the same time as and in parallel with the coiling section regardless of the number of steps of processing the ends of the coiled spring. In order to allow such a coiled spring making system to function satisfactorily, even w hen coiled springs of various length and shapes are formed at the coiling section, the coiled springs differing in the direction of turning of the coiled portions and the diameter, length, number of turns and pitch of coils and including at their leading and terminating ends arms which may be reduced to zero in length, the coiled springs can stably and securely be gripped directly with members for gripping and progressively feeding the coiled springs at the progressive forming section. In addition, forming occurring at the respective stages can be carried out without trouble, and the coiled spring formed at the coiling section can stably and securely be located at a grip position on the progressive forming section. Thus, even a technician having an elementary knowledge can easily work out preparatory steps and make coiled springs at high production rates.

SUMMARY OF THE INVENTION

The present inventors have made intensive and extensive studies of various methods relying upon the bending die system of coiling section and capable of forming even coiled springs including at their leading and terminating ends arms which may be reduced to zero in length and may be not only in linear forms but in forms provided with annular or arched hooks on their way.

According to the first method, a progressive forming section where coiled springs formed at the bending die system of coiling section are gripped and progressively fed to a plurality of stages on which they are formed simultaneously with their ends being successively processed to a desired shape is of such a structure that the position for gripping the coiled springs is determined in coincidence with the position of the coiled springs formed at the coiling section fixed in place.

According to the second method, the bending die system of coiling-section is of such a structure that the coiled springs formed thereat are produced at the predetermined position of a progressive forming section for gripping the coiled springs, which is located at a fixed position at which the coiled springs are gripped and progressively fed to a plurality of stages where they are formed simultaneously with their ends being successively processed into a desired shape.

According to the third method which is a combination of the first method with the second method, the bending die system of coiling section is of such a structure that the coiled springs formed thereat are produced at a position of a progressive forming section at which they are easily gripped, and are to be progressively fed to a plurality of stages on which they are formed simultaneously with their ends being successively processed into a desired shape, and a forming section is of such a structure that the coiled springs can be gripped at a position at which they are formed at the coiling section.

Such three methods have been studied in detail. As a result, it is found that the first method is not preferable in terms of the movement of the progressive forming section which, in most cases, is of a complicated structure of increased weight because of various tools provided in consideration of the fact that the produced coiled springs may include at their leading and terminating ends arms of various length and shapes which may be reduced to zero in length or be either sinistral or dextral, and the thickness of the starting wire and the diameter of the coiled portions may differ. It is also found that the third method is not preferable in that the coiled spring making apparatus is of a more complicated and costly structure, since it comprises the first method additionally combined with the first method. It is thus found that an apparatus of the simplest structure is achievable by the second method.

Thus, the second method has been studied in view of the system for gripping and progressively feeding the coiled springs formed at the coiling section. As a result, it has been found for the reasons described later that if reliance is placed upon a progressive system in which a coiled spring is gripped at its part (its barrel, leading or terminating end) and is then progressively fed as gripped, then forming of high accuracy can be repeatedly carried out with a simple mechanism but without any special coiled spring positioning means at the respective forming stages, since it is general that the coiled spring is formed at its ends or arms and the coiled spring is gripped at its part and is then progressively fed as gripped. It has further been found that the coiled spring can stably and positively be gripped with high accuracy, since it is designed to be gripped prior to the cutting of its terminating end or arm. Still further, it has been found that when the number of turns of the coiled spring is increased, satisfactory results are obtained by gripping its terminating end as well as its leading end. Still further, it has found that when inconvenience is experienced in progressively feeding a part of the coiled spring formed at the coiling section as gripped, satisfactory results are obtained by changing the angle of gripping the coiled spring at a certain stage of the progressive forming section, preferably at an early stage the progressive feeding of the coiled spring is initiated.

According to the present invention, there is provided a coiled spring making apparatus including a coiling section for forming a coiled spring having at its leading and terminating ends arms which may be reduced to zero in length and a progressive forming section in which coiled springs formed at the coiling section are gripped and progressively fed to a plurality of stages on which their ends are successively processed into a desired shape, wherein:

the position of the progressive forming section on which the coiled spring is to be placed is regulated to a given position and the coiling section is provided by a bending die system of coiling section in which forming occurs with the central axis of the coiled spring being vertically located, whereby gravity acting upon a coiled portion of the coiled spring to be produced is constantly located just below the axis of the coiled portion, thereby making it easy for the progressive forming section to grip the coiled spring with high accuracy in a stable and positive manner and eliminating such a problem that the coiled spring deteriorates considerably in terms of loading properties by being subjected to vibration due to its own weight, as occurring when the coiled portion is formed horizontally as is the case with a conventional coiled spring making apparatus, thus making it possible to produce the coiled portion at high speeds and in a stable manner. Further, if the coiling section is placed on a table movable to any horizontal or transverse position with respect to the progressive forming section and fixed there, then the structure of the apparatus can be further simplified.

BRIEF DESCRIPTION OF THE DRAWINGS

For a better understanding of the present invention, some embodiments thereof will now be explained in detail with reference to the accompanying drawings which are given for the purpose of illustration alone and in which.

DETAILED EXPLANATION OF THE PREFERRED EMBODIMENTS

Figure 1:
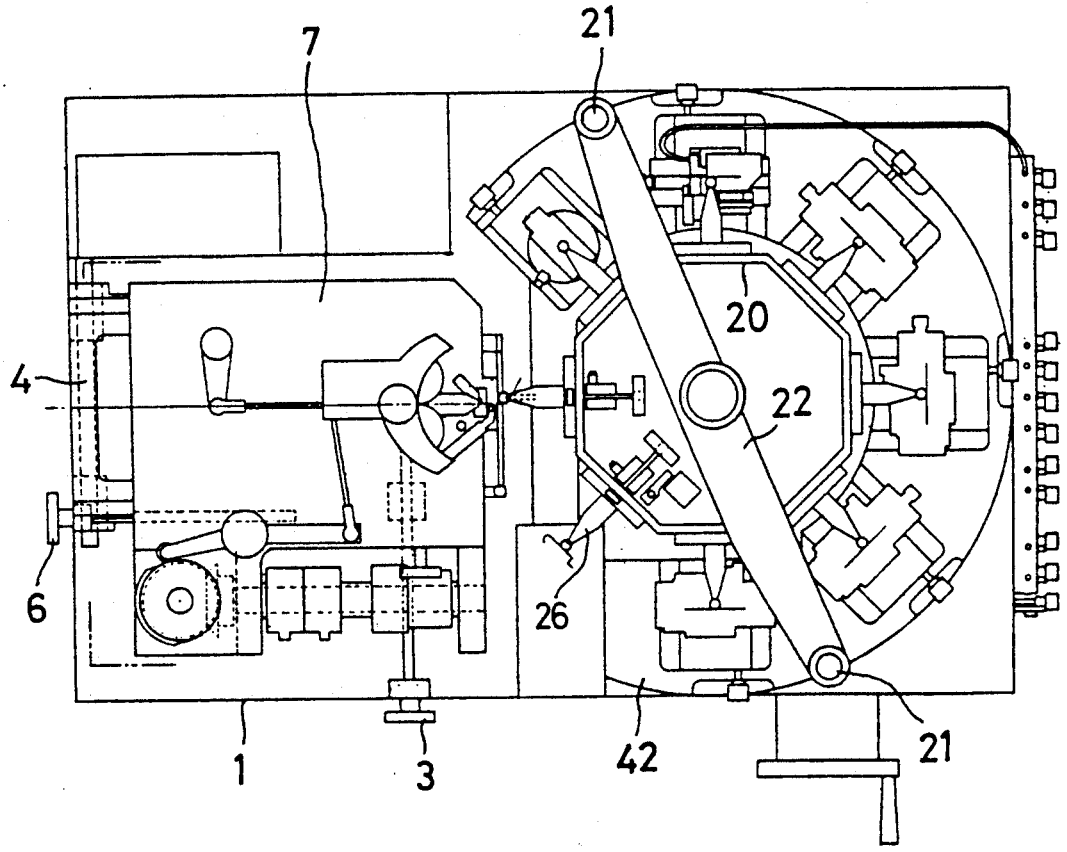
FIG. 1 is a plan view of one embodiment of the coiled spring making apparatus according to the present invention.

Throughout the drawings, reference numeral 1 generally stands for a framework for coiled spring making apparatus, in which are accommodated a motor providing a driving source, a reduction gear, a power transmission mechanism, an operating mechanism comprising a cam and lever combination, an electronic control for a servo motor, a signal generator for pneumatic equipment and so on. In FIG. 1, a coiling section and a progressive forming section are supported on the right and left sides, respectively.

A first pair of rails 2 are fixedly provided on the framework 1 in a direction normal to the direction along which a wire is fed, the wire being coiled at the coiling section, and a screw rod 3 for horizontal adjustment is turnably fitted into the framework 1 and in parallel with the rails 2. A support table 4 is movable on the rails 2, and is threadedly provided in its lower portion with a female screw, within which the screw rod 3 is engaged. Thus, with the adjust screw rod 3 turned, the support table 4 is moved in parallel with the rails 2 (i.e., horizontally) to a desired position on the framework 1 and retained there. A pair of rails 5 are fixedly provided on the support table 4 perpendicularly with respect to the first pair of rails 2, and a screw rod 6 for tranverse adjustment is turnably fitted into the support table 4 and located in parallel with the second pair of rails 5, i.e., at right angles with respect to the adjust screw rod 3. A main table 7 is movable on the second rails 5, comprising a main plate 7a, an underplate 7b, side frames 7c and 7d making a connection therebetween and a gear box 7d. Within a female screw threadedly provided in the side frame 7d of the main table 7, there is engaged on extreme end of the adjust screw rod 6. Thus, as the adjust screw rod 6 turns, the main table 7 is moved in parallel with the second rails 5 (i.e., traversely) to a desired position on the support table 4 and held there.

It is here noted that both the support tables 4 and 7 movable horizontally and transversely with respect to the adjacent progressive forming section will hereinafter be jointly called as the "movable tables".

The above main table 7 is thus incorporated thereon with the whole of the the coiling section to make a coiled spring on the main plate 7a, which includes at its both ends arms which may be reduced to zero in length. Although the apparatus of the present invention is substantially similar to a conventional bending die type of coiler (referred to generally as a coiling machine) in the parts involved and thus how to assemble and handle it, it is compactly designed so as to achieve the characteristic features to be described below.

The apparatus of the present invention is characterized in that, as already mentioned, a coiled spring is formed on the coiling section with its axis kept vertical, and the movable tables of the coiling section are moved to and fixed at any position horizontally or transversely with respect to the adjacent progressive forming section in order that the thus formed helical spring can be gripped directly by a pick-up unit of that forming section.

Consequently, the steps of making coiled springs at the coiling section will now be explained only by brief reference to the structures and actions of the main parts involved.

Figure 2:
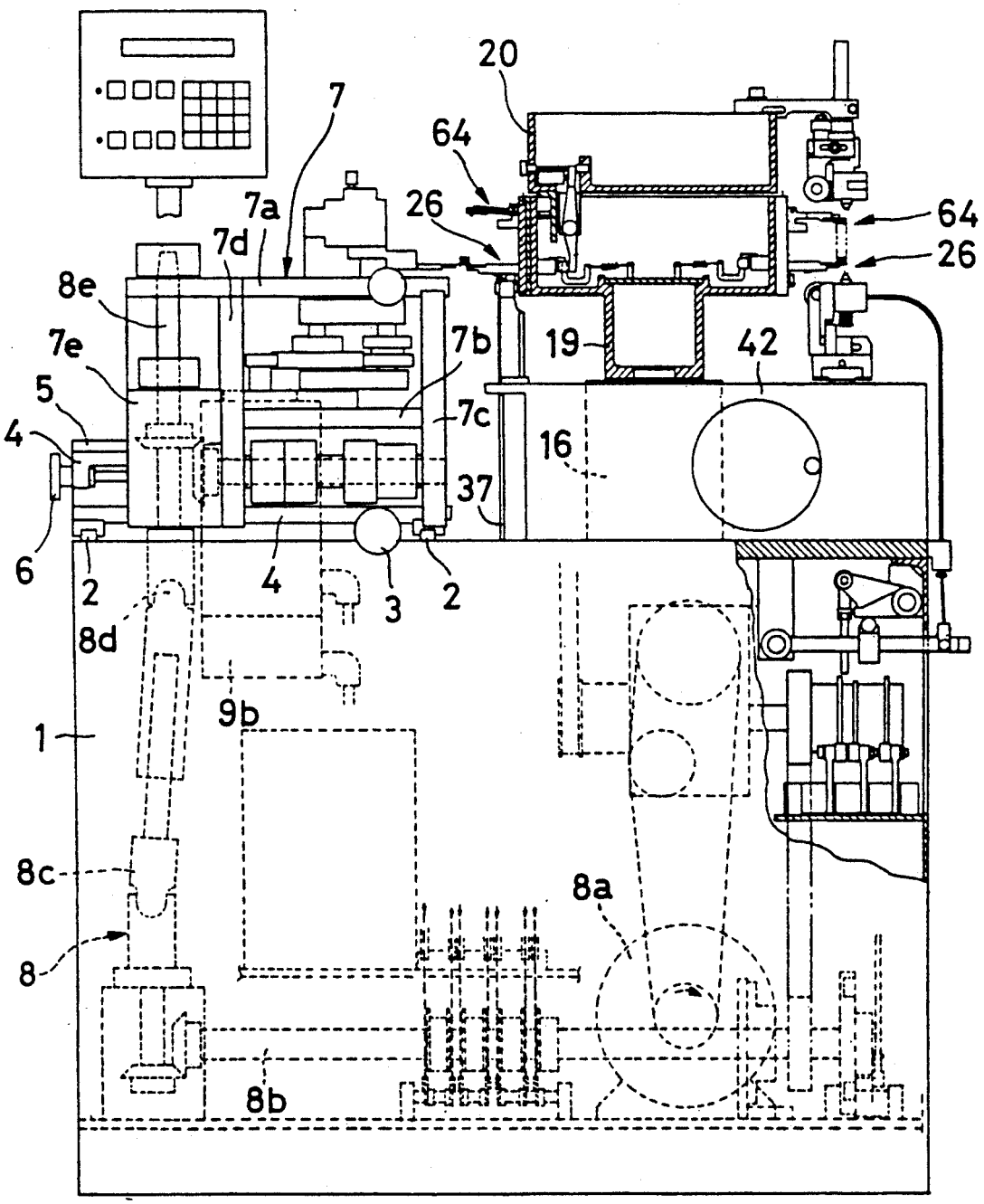
FIG. 2 is a front view of that one embodiment, in which only main parts of the progressive forming section are depicted in section.
Figure 3:
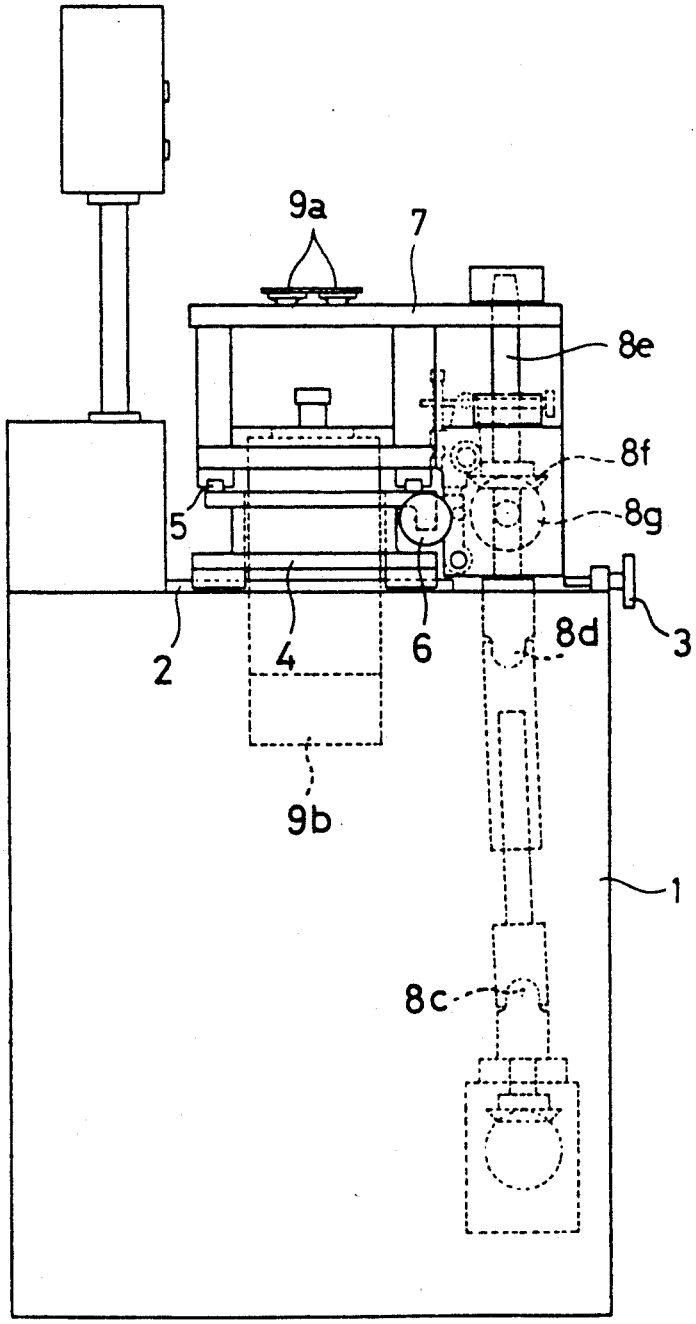
FIG. 3 is a left-hand side view of that embodiment.
Figure 4:
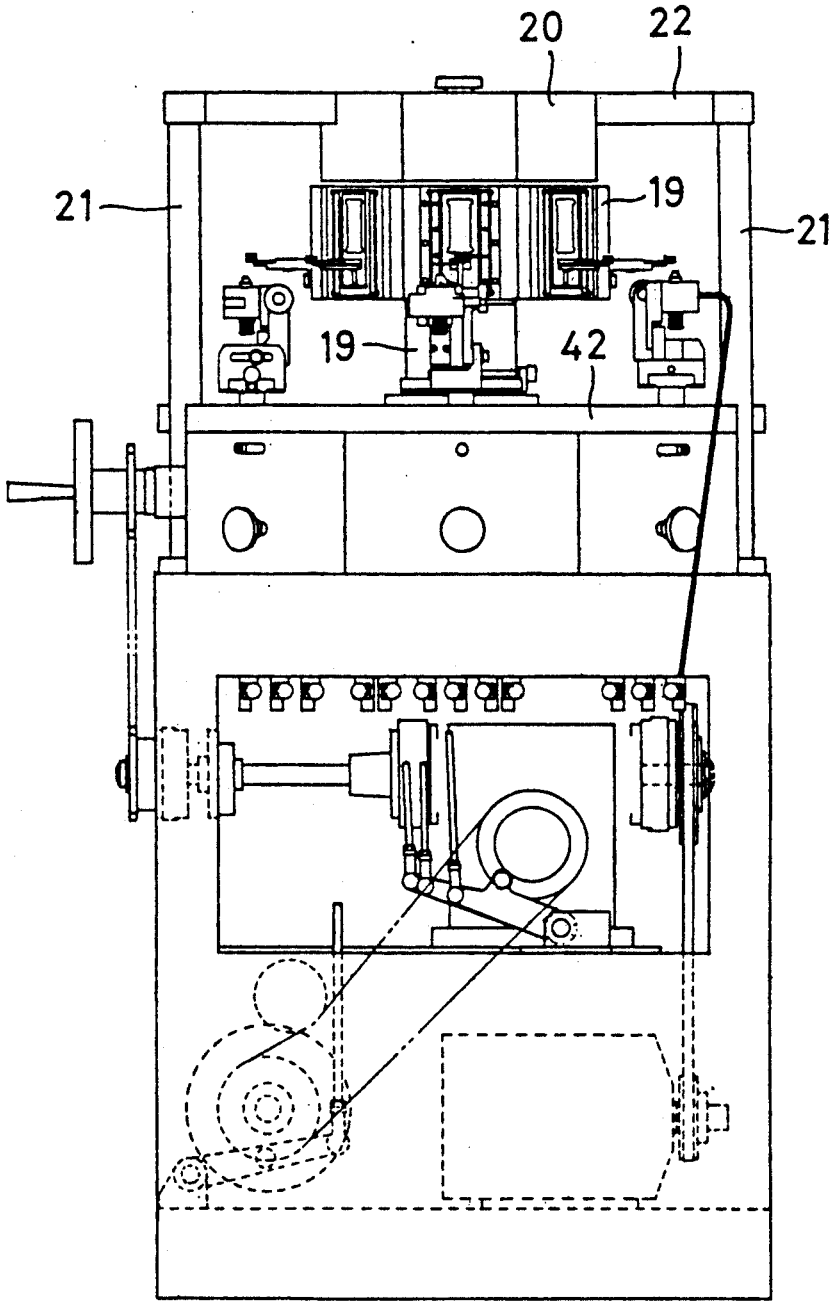
FIG. 4 is a right-hand side view of that embodiment.
Figure 5:
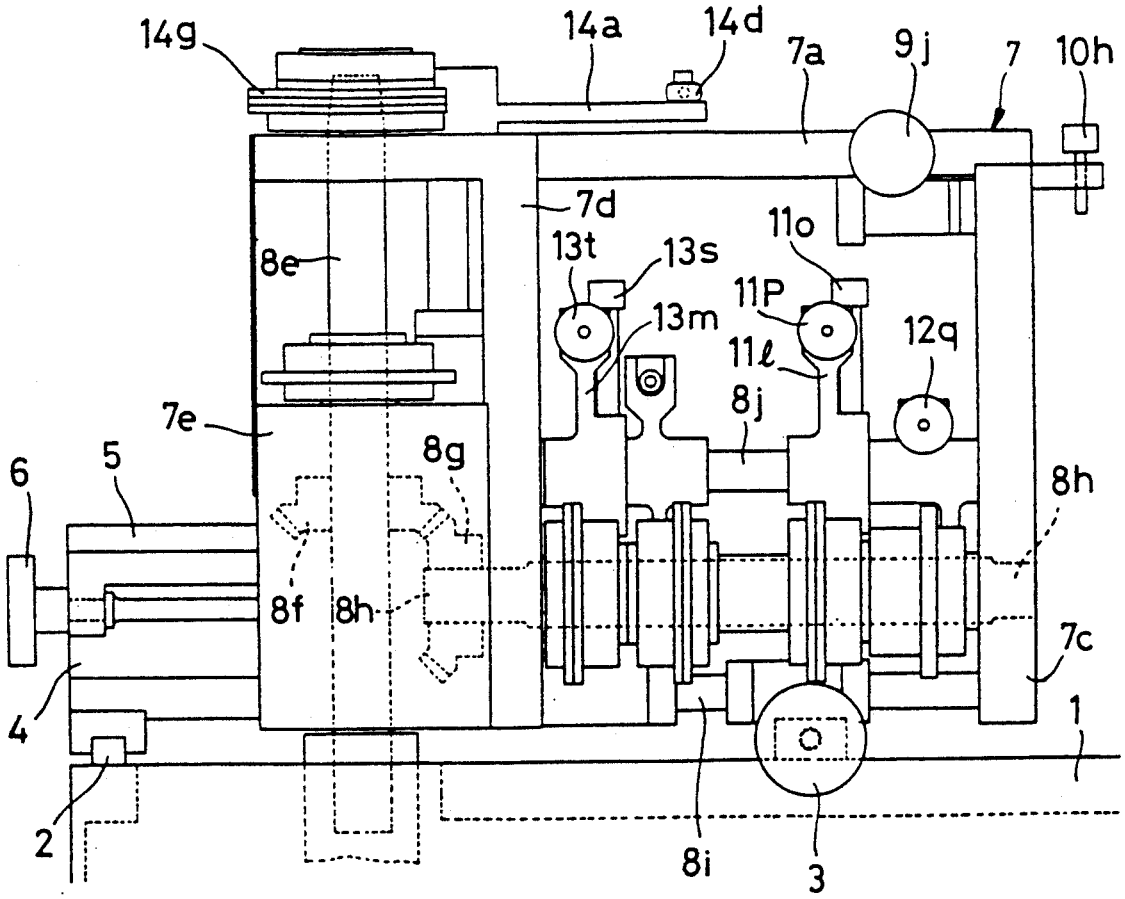
FIG. 5 is a front view illustrative of the structure of the power unit in the coiling section.

Referring to a power unit 8, a driving force of a driving shaft 8b driven by a motor 8a built in the framework 1, as illustrated in FIG. 2, is transmitted through universal joints 8c and 8d and then a main shaft 8e supported in the gear box 7e within the main table 7 to a cam shaft 8h supported on the side frames 7c and 7d of the main table 7 through bevel gears 8f and 8g in the gear box 7e housed in the main table 7, as shown in FIG. 5. The action of a cam fixed to the cam shaft 8h is then transmitted to main and auxiliary levers rocking around shafts 8a and 8j fitted at their both ends into the side frames 7c and 7d of the main table 7. It is noted that the main shaft 8e of the power unit 8 is fixedly provided at its upper end with a bending die operating cam to be described later, and that the cam shaft 8h thereof is fixedly provided with a wire cutting cam, a pitch tool operating cam, a coil diameter adjusting cam and so on.

Figure 6:
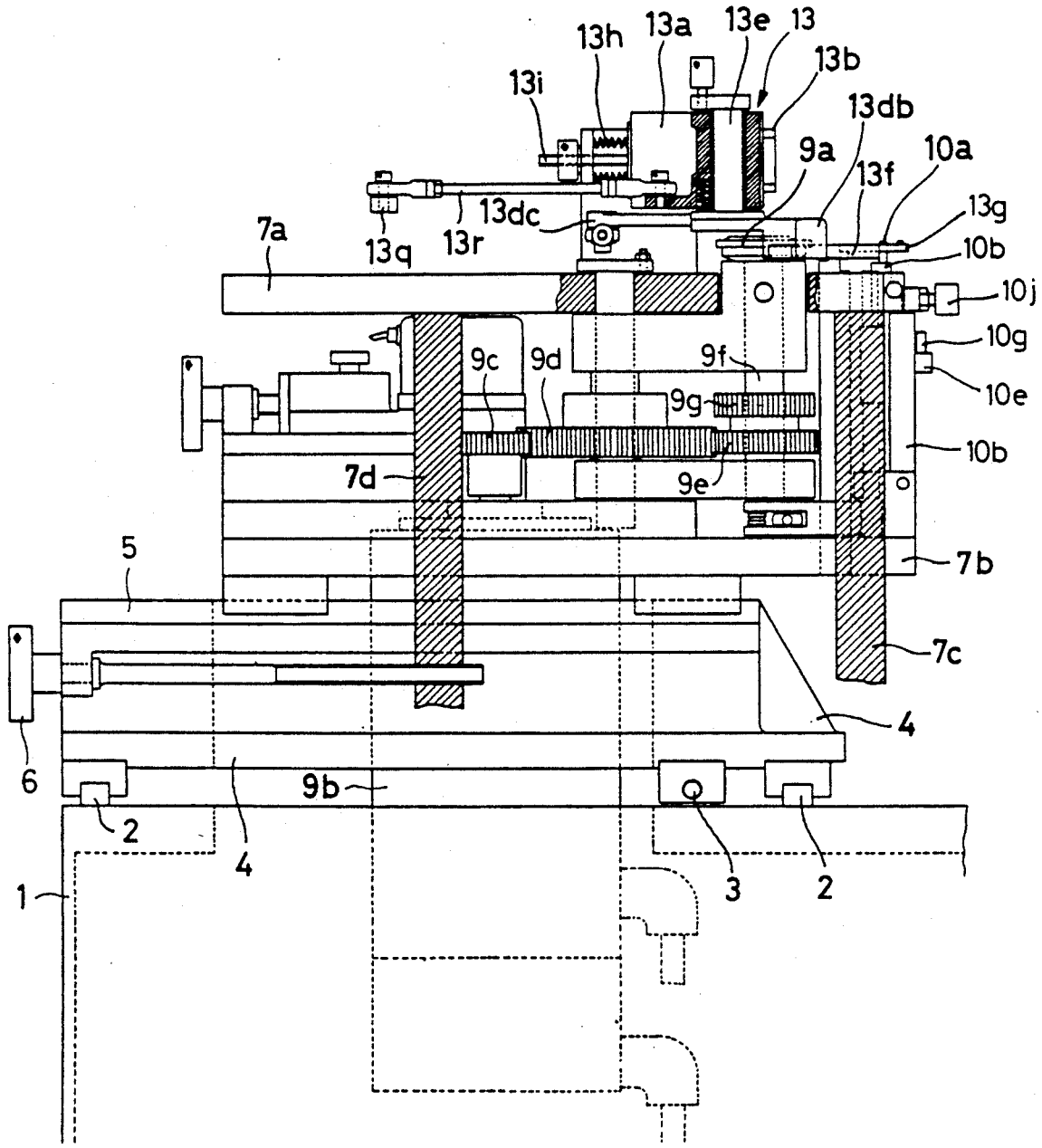
FIG. 6 is a front view illustrative of that structure, in which only its main parts are depicted in section.
Figure 7:
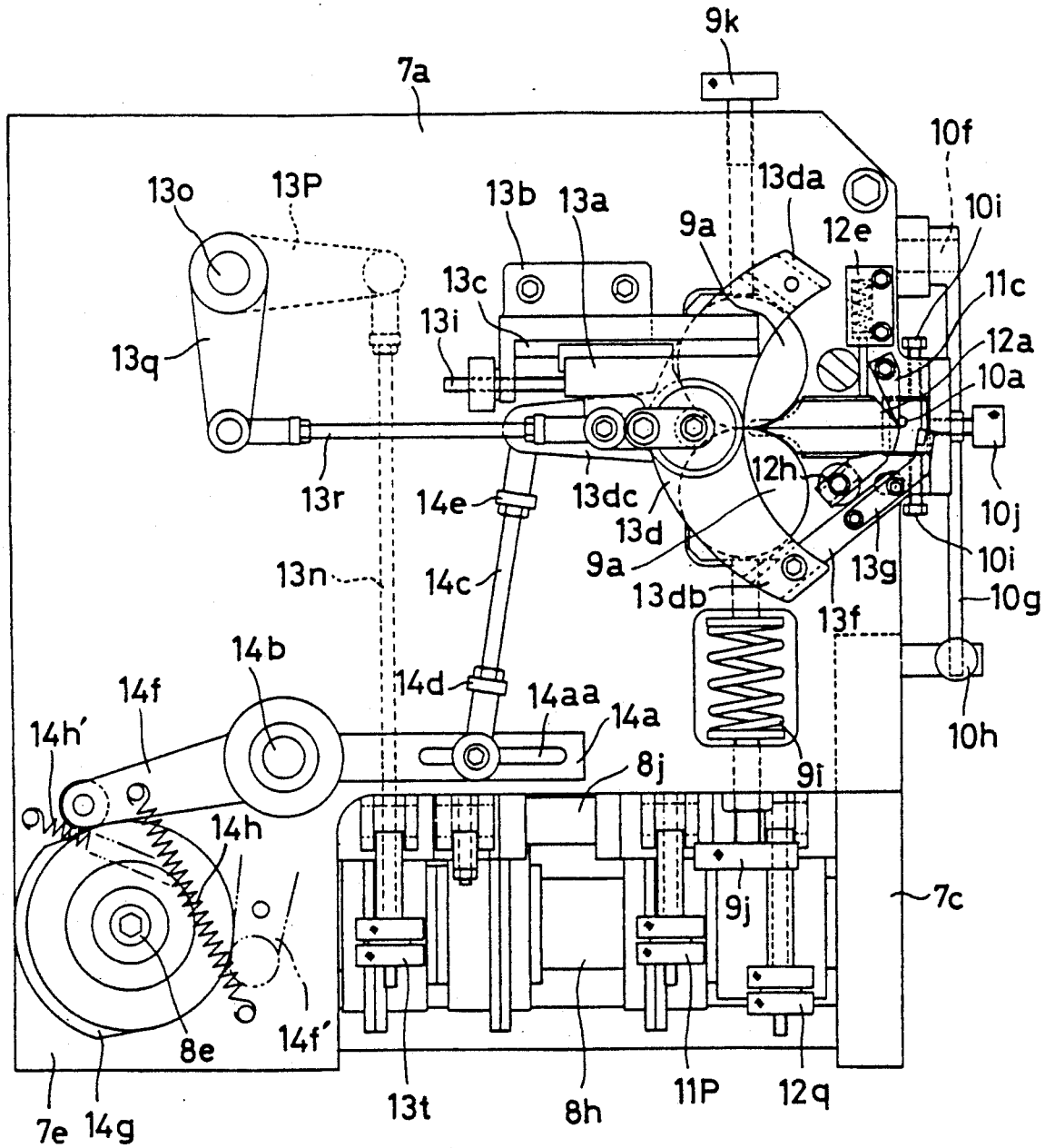
FIG. 7 is a plan view of the coiling section.
Figure 8:
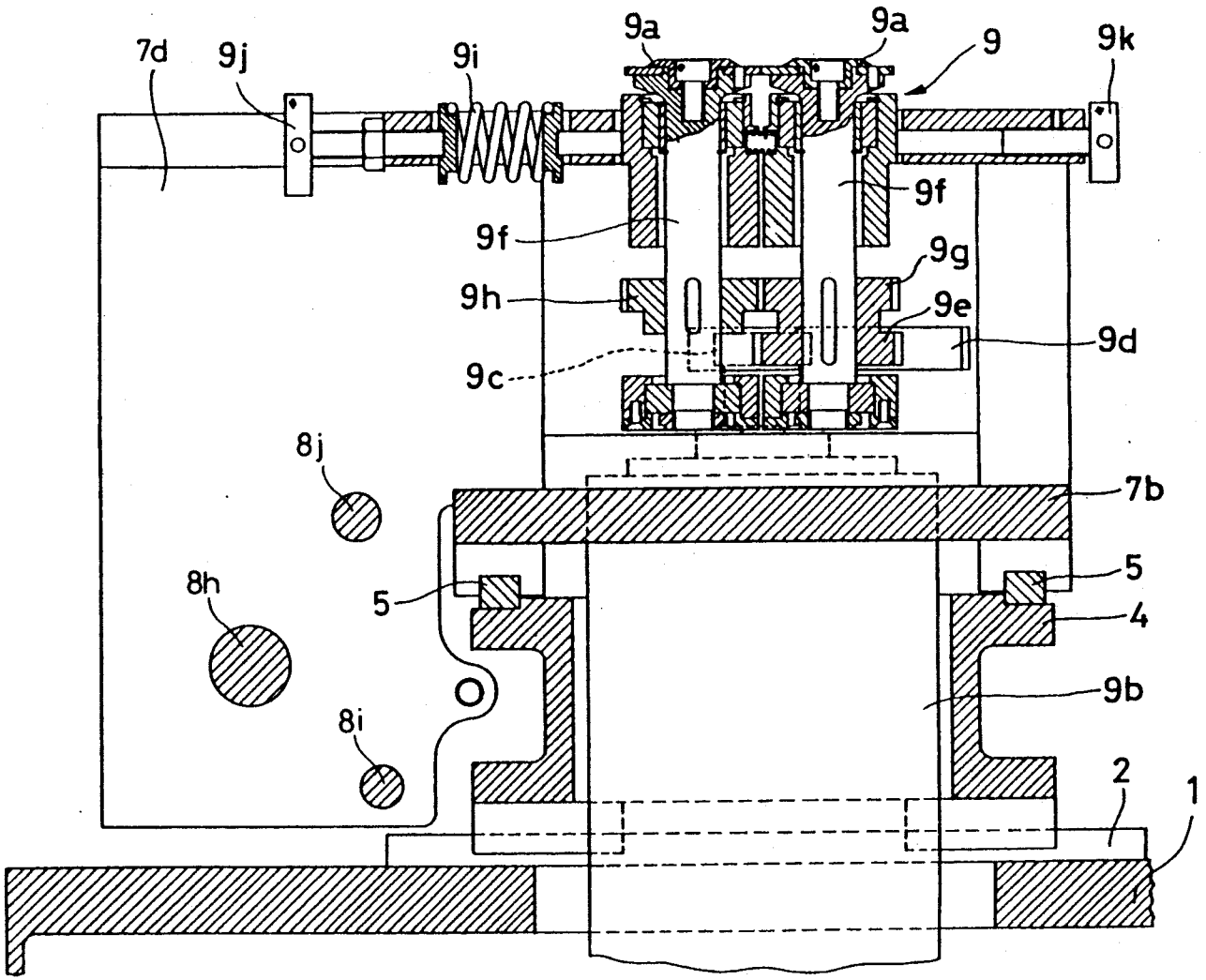
FIG. 8 is a sectional view illustrative of the structure of the feed rollers driving unit at the coiling section.

Provided is a feed roller driving unit 9 in which, as illustrated in FIGS. 6 and 8, power is transmitted from a pinion 9c fixed to an output shaft of a servomotor 9b screwed to a lower face of the underplate 7b of the main table 7 to a gear 9e fixed to a roller shaft 9f by way of an intermediate gear 9d. With the gear 9e driven, feed rollers 9a fixed to roller shafts 9f are rotated to feed out a wire held therebetween. It is noted that 9g and 9h denote gears for making a connection between the roller shafts 9f to which the feed rollers 9a for taking hold of a wire therebetween are fixed, as illustrated in FIG. 8; 9i denotes a compression coiled spring adapted to engage one of the feed rollers 9a to hold a wire therebetween, as illustrated in FIG. 7; 9j, a pressure adjusting screw for regulating the compression force of the compression coiled spring 9i; and 9k, a screw for regulating the position of the feed rollers 9a.

Referring more specifically to the feed roller driving unit 9, as the servomotor 9b screwed to the lower face of the underplate 7b of the main table 7 is driven, the power is transmitted from the pinion 9c fixed to the output shaft thereof to the gear 9e by way of the intermediate transmission gear 9d to rotate one roller shaft 9f, and the other roller shaft 9f, to which the connecting gear 9h in mesh with the connecting gear 9g fixed to said one roller 9f is fixed, is rotated in the opposite direction as many times as the one roller shaft 9f does. Thus, the wire held between the feed rollers 9a is fed out, one feed roller 9a being engaged by the compression coiled spring 9i fixed to the two roller shafts 9f designed to turn at the same speed in the opposite directions and having its compression force adjusted by the pressure adjusting screw 9j, while the other feed roller 9a being of the same diameter of the one feed roller 9a and having its position adjusted by the position adjusting screw 9k.

Figure 9:
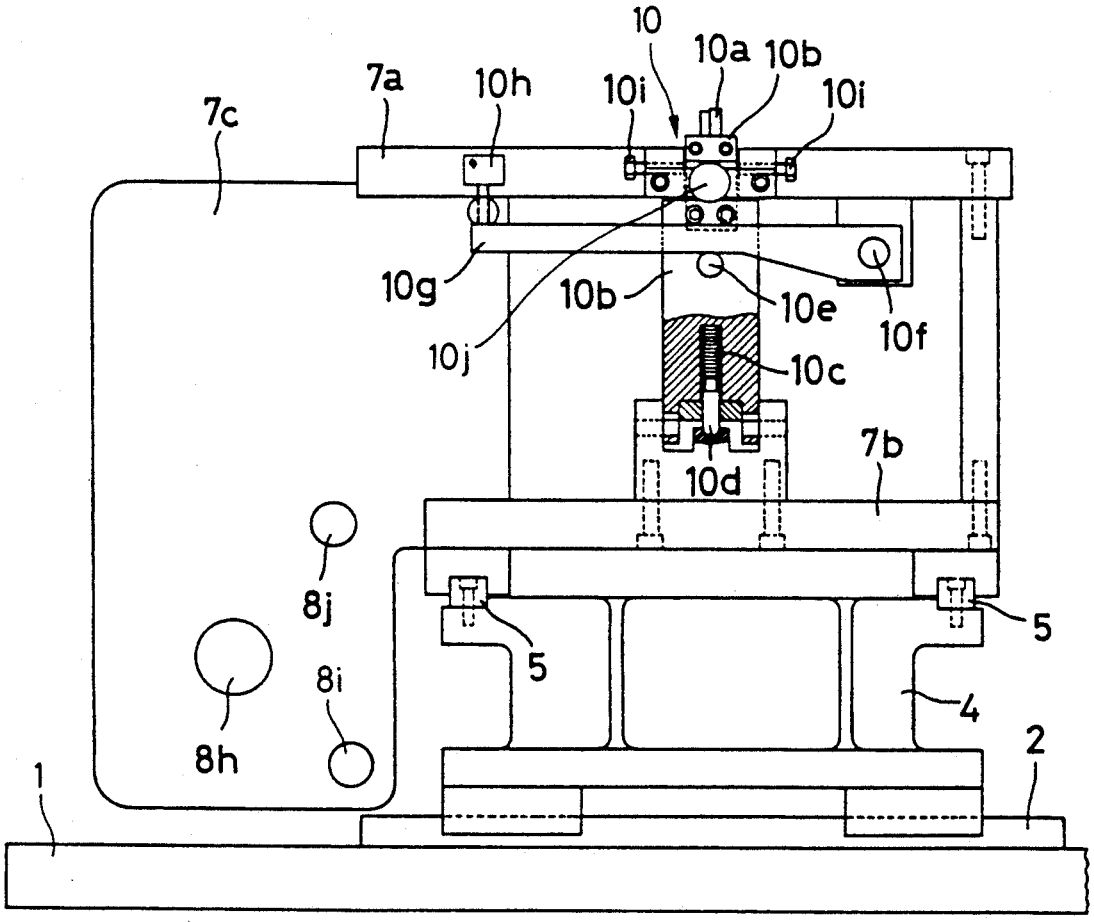
FIG. 9 is a right-hand side view, partly sectioned, illustrating a part of the structure of the core bar adjusting mechanism.

A core adjusting mechanism 10 is provided for the regulation of a core bar 10a to cut the wire between the core adjusting mechanism and a wire guide 12a of a wire cutting mechanism 12. As illustrated in FIG. 9, the core bar 10a is fixed to a core bar holder 10b which constantly receives an upward force applied by a dish spring 10c put in a bore provided in a lower portion of that mechanism 10 and a spring bearing pin 10d therefor, and a shaft 10e screwed to the core bar holder 10b abuts against a lever 10g having its position limited by an adjust screw 10h turnably provided at its one end to a shaft 10f provided on a lower portion of the main plate 7a of the main table 7 and threadedly provided at its other end to the side frame 7c of the main table 7. Thus, the core bar 10a is limited in terms of its upper and lower positions, and is regulated in terms of its horizontal and transverse positions by adjusting screws 10i and 10j threadedly provided to the main plate 7a of the main table 7.

Referring again to the core bar adjusting mechanism 10, the core bar 10a is fixedly provided to the core bar holder 10b constantly lifted up by the dish spring 10c put into the bore formed in the lower portion thereof and the spring bearing pin 10d therefor and having the shaft 10e screwed to its side, and is limited in terms of its upper and lower positions by regulating the position of the shaft 10e abutting upon the lower face of the lever 10g pivotally fixed at its one end to the lower shaft 10f of the main plate 7a of the main table 7 and the position of the other end of the lever 10g. The core bar 10a is also regulated in terms of its horizontal and transverse positions by the adjust screws 10i and 10j threadedly fixed into the main plate 7a of the main table 7 to locate a proper position through the wire guide 12a of the wire cutting mechanism 12, at which the wire is to be cut.

Figure 10:
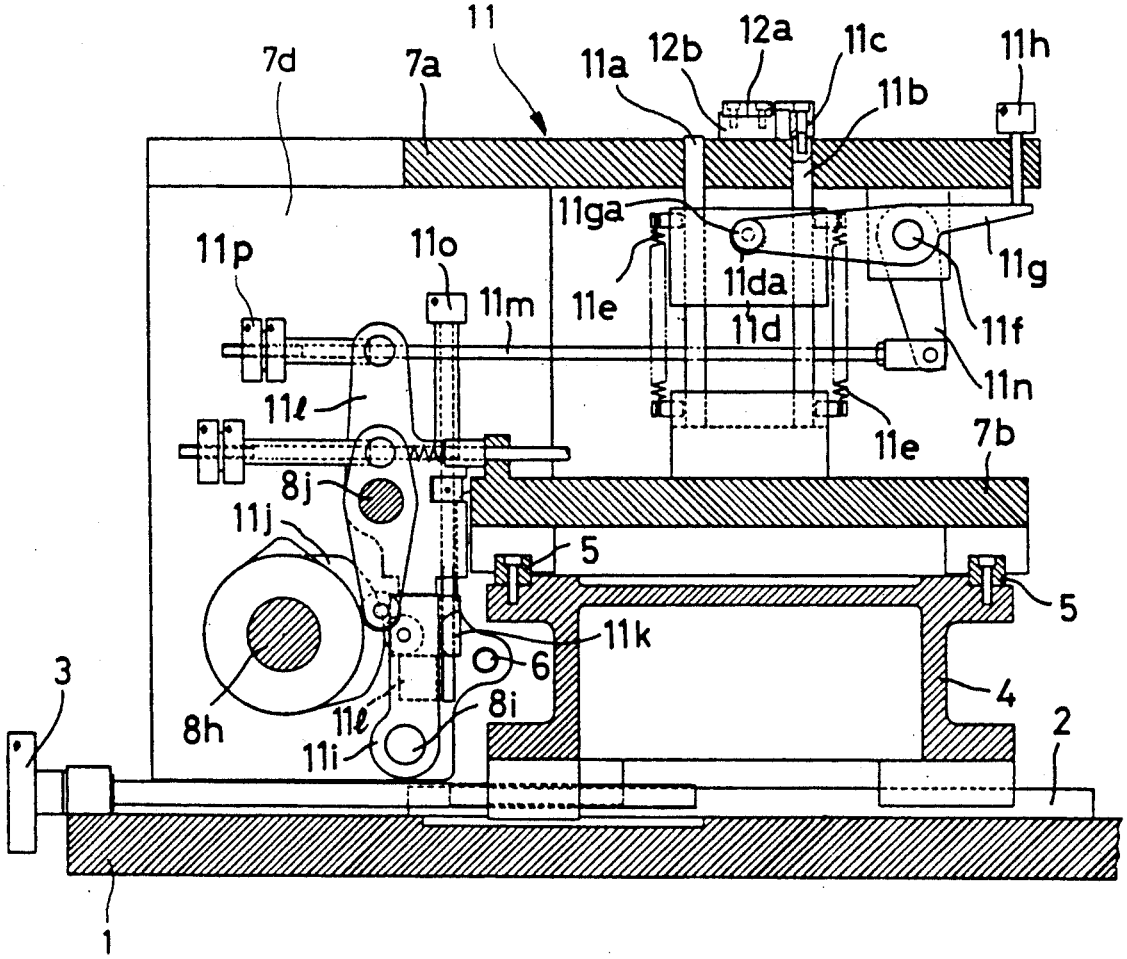
FIG. 10 is a right-hand side view, partly sectioned, illustrating the structure of the pitch tool operating mechanism at the coiling section.

As illustrated in FIG. 10, a pitch tool operating mechanism, shown generally at 11, for the actuation of a pitch tool 11c is provided to limit the pitch of the coiled portion to be formed. When forming a right-handedly or dextrally coiled spring, the pitch tool 11c is screwed to a pitch rod 11b for dextral coiling, as illustrated in FIG. 7. When forming a left-handedly or sinistrally coiled spring, on the other hand, it is screwed to a pitch rod 11a for sinistral coiling. As illustrated in FIG. 10, both the pitch rods 11b and 11a for right-handed and left-handed coiling are disposed through the lower portion of the main plate 7a of the main table 7, and is fixed through a block 11d which constantly receives downward forces exerted by tension springs 11e mounted on its both sides. The block 11d is provided therein with a round hole 11da into which a shaft 11ga is inserted, the shaft 11ga being mounted at one end of a lever 11g fixed to a connecting shaft 11f pivotally supported on a lower portion of the main plate 7a of the main table 7. The other end of the lever 11g is limited in terms of position by an adjust screw 11h threadedly provided into the main plate 7a of the main table 7. A main lever 11i is pivotally fixed to the shaft 8i of the power unit 8 fitted into the side frames 7c and 7d of the main table 7, and is pivotally rocked upon receipt at given timing of the action of a cam 11j fixed to the cam shaft 8h. Then, an auxiliary lever 11l pivotally fixed to the shaft 8j through a stroke adjusting block 11k is actuated to pull a connecting screw rod 11m. Thereupon, a lever 11n fixed to the connecting shaft 11f is pulled, so that the pitch tool 11c can be forced up by the lever 11g through the connecting shaft 11f against the forces of the tension springs 11e, thereby providing a pitch to a coil which is being coiled. It is appreciated that pitch regulation is achievable either by sliding the auxiliary lever 11l to move the stroke adjusting block 11k interposed between it and the main lever 11i by an adjust screw 11o or an adjust screw 11p in threaded engagement with a connecting screw rod 11m.

Thus, the pitch tool operating mechanism 11 is provided to limit the pitch of the coiled portion to be formed by the vertical movement of the pitch tool 11c which is fixedly screwed to the pitch rod 11b for right-handed coiling when the coiled spring to be formed is a right-handedly coiled spring or the pitch rod 11a for left-handed coiling when the coiled spring to be formed is a left-handedly coiled spring. As already mentioned, the pitch rods 11b and 11a for right-and left-handed coiling are fixed through the block 11d which is constantly subjected to the downward forces of the tension springs 11e. As the main lever 11i pivotally fixed to the shaft 8i of the power unit 8 fitted into the side frames 7c and 7d of the main table 7 is pivotally rocked upon receipt at given timing of the action of the cam 11j fixed to the cam shaft 8h, the auxiliary lever 11l pivotally fixed to the shaft 8j through the stroke adjusting block 11k is actuated to pull the connecting screw rod 11m, thereby pulling the lever 11n fixed to the connection shaft 11f pivotally fixed to the lower portion of the main plate 7a of the main table 7. This then causes the pivotal turning of the lever 11g integral with the connecting shaft 11f, so that the block 11d is caused to ascend and be forced up through the round hole 11da into which is inserted the shaft 11ga mounted at one end of the lever 11g, thereby providing a pitch to the coil. The regulation of the pitch thus provided is again achievable either by sliding the auxiliary lever 11l to move the stroke adjusting block 11k interposed between it and the main lever 11i by the adjust screw 11o or using the adjust screw 11p in threaded engagement with a connecting screw rod 11m to vary the vertical strokes of the pitch rods 11b and 11a for right- and left-handed coiling, viz., the pitch tool 11c.

Figure 11:
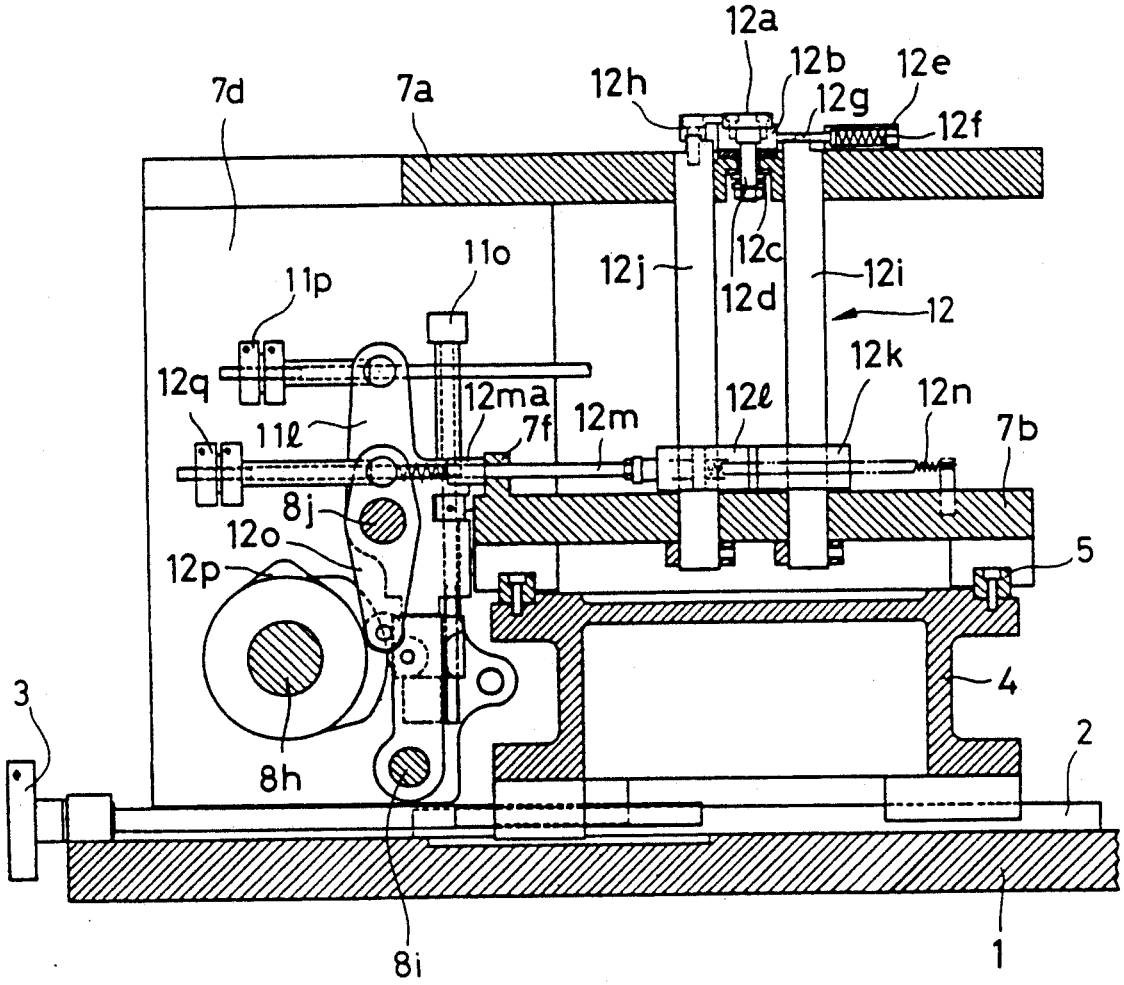
FIG. 11 is a right-hand side view, partly sectioned, illustrating the structure of the wire cutting mechanism at the coiling section.
Figure 13:
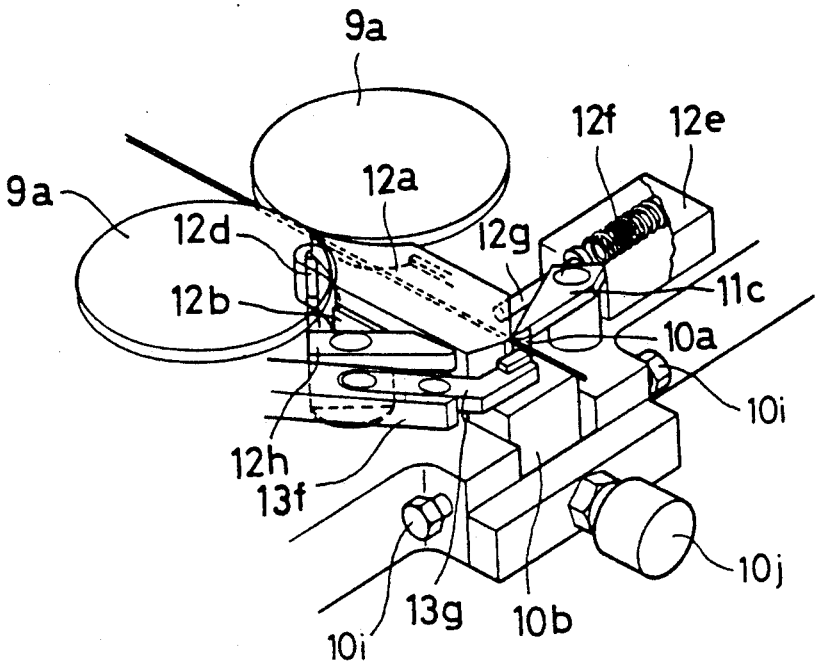
FIG. 13 is a perspective view of the coiling section.

As illustrated in FIG. 11, a wire cutting mechanism, shown generally at 12, is provided to cut the wire fed out through the feed rollers 9a of the feed roller driving unit 9 with the core bar 10a and a wire guide 12a. The wire guide 12a, as illustrated, is screwed to a wire guide holder 12b around a support shaft 12d firmly attached onto the main plate 7a of the main table 7 by force of a compression coiled spring 12c and adapted to turn at its extreme end (or its side facing the core bar 10a), as illustrated in FIG. 13, and turnably supported through the main plate 7a. This wire guide 12a is constantly in receipt of such a force that it is rotated around the support shaft 12d away from the block 12e, since it is in abutment upon an extreme end of a spring bearing pin 12g which receives the force of a compression coiled spring 12f built in a block 12e located on the main plate 7a of the main table 7 and on the right side thereof in FIG. 13. As the wire guide 12a is held on its left side by an arm 12h in FIG. 13, however, it is kept at a constant position unless that arm 12h is on the move. This arm 12h is screwed to a cutting shaft 12i for a left-handedly coiled spring when forming a left handedly coiled spring and to a cutting shaft 12j for a righthandedly coiled spring, as illustrated in FIG. 11, when forming a right-handedly coiled spring. (In the illustrated embodiment where the right-handedly coiled spring is to be formed, it is screwed to the cutting shaft 12j for a right-handedly coiled spring). The cutting shafts 12i and 12j for left- and right-handedly coiled springs are fixedly provided with sector gears 12k and 12l in mesh with each other, one sector gear 12l being in a right-angled form and having its one arm connected to a connecting screw rod 12mm which is pulled right-handed in FIG. 11 by a tension coiled spring 12n. A collar 12ma is located substantially at the center of the connecting screw rod 12m, and is in abutment upon a stopper 7f screwed to the underplate 7b of the main table 7 to limit the angle of turning of the cutting shafts 12i and 12j. A lever 12o pivotally supported on the shaft 8j of the power unit 8 fitted into the side frames 7c and 7d of the main table 7 is then pivotally rocked upon receipt of the action at given timing of a cam 12p fixed to the cam shaft 8h to pull the connecting screw rod 12m against the tension coiled spring 12n. Thereupon, the cutting shafts 12i and 12j are turned with the sector gears 12k and 12l connected to the connecting screw rod 12m, so that the arm 12h causes the wire guide 12a to be turned toward the block 12e around the support shaft 12d against the force of the compression coiled spring 12f. In consequence, the wire is cut with the core bar 10a and the extreme end of the wire guide 12a. It is noted that reference numeral 12q stands for an adjust screw threadedly engaged with the end of the connecting screw rod 12m so as to regulate the stroke of the arm 12h.

Referring again to the wire cutting mechanism 12, the wire guide 12a is screwed to the wire guide holder 12b turnable at its extreme end facing the core bar 10a around the support shaft 12d firmly attracted to the main plate 7a of the main table 7 by force of the compression coiled spring 12c and turnably supported therethrough. The cutting shaft 12i or 12j for sinistrally or dextrally coiled springs, to which the arm 12h holding one side of the wire guide 12a is screwed, is turned upon receipt of the compression coiled spring 12f built in the block 12e on the main plate 7a of the main table 7 against the spring bearing pin 12g engaging the other side of the wire guide 12a, whereby the wire held between and fed out through the feed roller 9a of the feed roller driving unit 9 is cut with the core bar 10a of the core bar adjusting mechanism 10 and the extreme end of the wire guide 12a. The lever 12o pivotally supported on the shafts 8j of the power unit 8 fitted into the side frames 7c and 7d of the main table 7 is then pivotally moved by the action at given timing of the cam 12p fixed to the cam shaft 8h so that, of the sector gears 12k and 12l fixed to the cutting shafts 12i and 12j and adapted to be rotatable in the opposite direction while meshing with each other, the connecting screw rod 12m connected to the right-angled arm of one sector gear 12l is rotated against the tension of the tension coiled spring 12n. In the process of forming the coiled portions of coiled springs, the wire cutting mechanism 12 operates as illustrated in FIGS. 12 to 17. It is appreciated that the angle of turning of the sector gear 12m when this is pulled is adjustable by the regulation of the stroke of the arm 12h with the adjust 12q threadedly engaged with the end of the connecting screw rod 12m.

Figure 12:
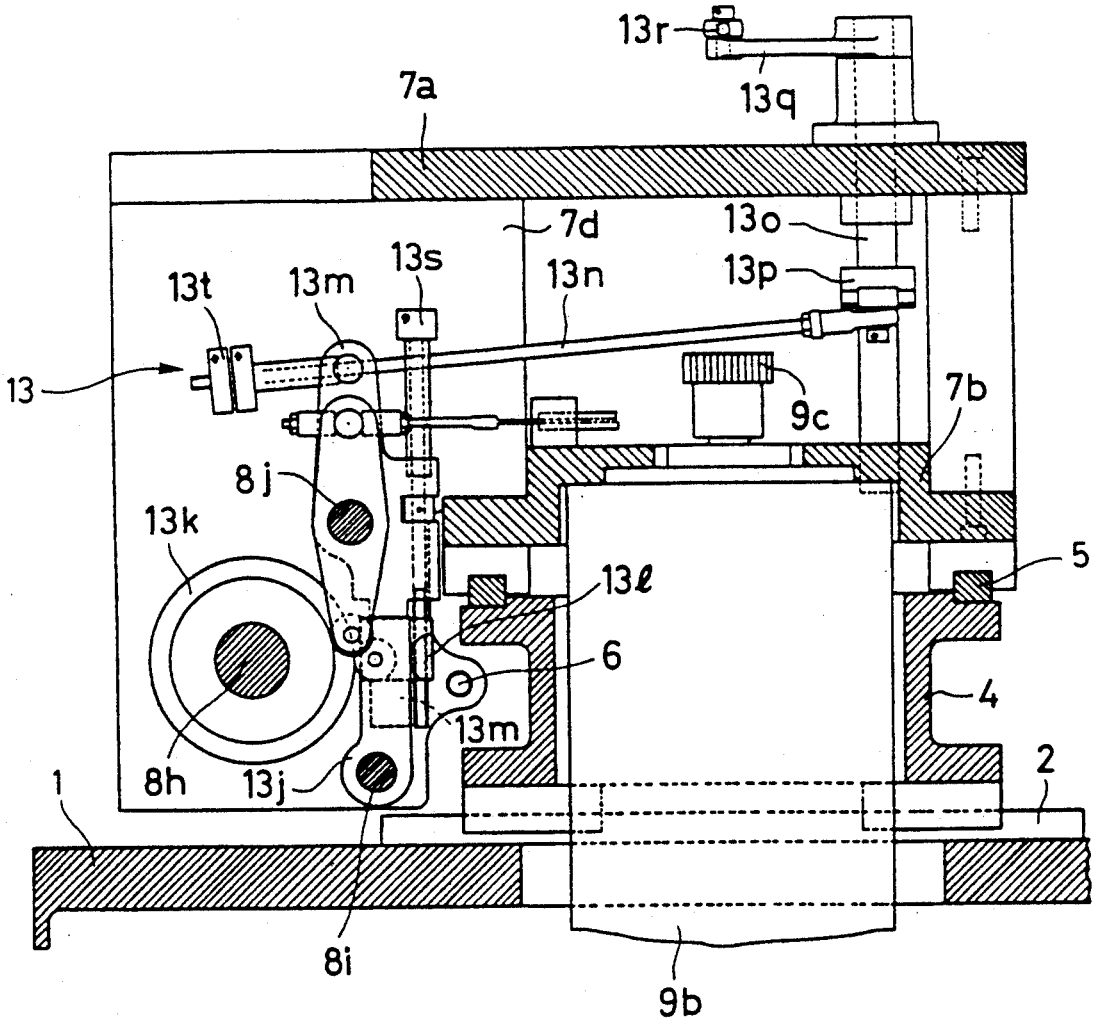
FIG. 12 is a right-hand view, partly sectioned, showing the structure of the coil diameter adjusting mechanism at the coiling section.

As illustrated in FIG. 12, there is provided a mechanism for regulating the diameter of the coil to be formed, shown generally at 13. As illustrated in FIG. 7, a slide 13a is slidingly movable on a rail 13c fixed to a support table 13b screwed to the main plate 7a of the main table 7, and is designed to turnably hold a vertical shaft 13e fixed at the centers of three arms 13da, 13db and 13dc of a bending die table 13d. The arm 13da is sued to form a sinistrally coiled spring. In the illustrated embodiment where a dextrally coiled spring is formed, however, a fitting 13f is screwed at its end to the arm 13db and is fixedly provided at its other end with a bending die 13g to be in abutment upon the wire by means of a screw. Connected to the remaining arm 13dc is a connecting rod 14c of a bending die operating mechanism 14 to rock the bending die table 13d, as will be described later. As illustrated in FIG. 6, the slide 13a is constantly urged in the direction of feeding the wire by force of two compression coiled springs 13h located between it and the support table 13b, and is limited in terms of position by an adjust screw 13i. With the bending die 13g fixed to the bending die table 13d through the fitting 13f being moved by the turning of the adjust screw 13i, however, the slide 13a is determined in terms of its position relative to the core bar 10a, thereby regulating the diameter of the coil portion to be formed. Referring to the operation of the coils diameter regulating mechanism 13, a main lever 13j pivotally supported on the shafts 8i fitted into the side frames 7c and 7d of the main table 7 is pivotally moved upon receipt at given timing of the action of a cam 13k fixed to the cam shaft 8h, as illustrated in FIG. 12. This then gives rise to the actuation of an auxiliary lever 13m supported on the shaft 8j through a stroke regulating block 13l, causing the connecting screw rod 13n to be pulled and actuating a lever 13p fixed to an intermediate portion of a connecting rod 13o turnably supported on the main plate 7a and underplate 7b of the main table 7. The slide 13a is then moved past a lever 13q fixed to an upper end of the connecting shaft 13o by a rod 13r making a connection between that lever 13q and the slide 13a to move the bending die 13g screwed to the bending die table 13d toward the core bar 10a, whereby the diameter of the coil can be reduced by the action of the cam 13k at giving timing during coil forming. The geometry of the coil diameter is then adjustable by an adjust screw 13s for moving the stroke adjusting block 13l interposed between the auxiliary lever 13m and the main lever 13j while slidingly fitted into the auxiliary lever 13m and an adjust screw 13t threadedly engaged with the connecting screw rod 13n.

Referring again to the coil diameter regulating mechanism 13, it includes the slide 13a for turnably holding the vertical shaft 13e of the bending die table 13d to which one end of the fitting 13f is fixed, the other end of the fitting 13f being fixed to one of the arms 13da and 13db for sinistrally and dextrally coiled springs. The slide 13a is movable on the rail 13c fixed to the support table 13b fixed to the main plate 7a of the main table 7, and is constantly urged in the direction of feeding the wire by the two compression coiled springs 13h disposed between it and the support table 13b. In operation, the main lever 13j pivotally supported on the shafts 8i fitted into the side frames 7c and 7d of the main frame 7 is rocked by the action at a given timing of the cam 13k fixed to the cam shaft 8h to actuate the auxiliary lever 13m supported on the shaft 8j through the stroke adjusting block 13l. This causes the connecting screw rod 13n to be pulled, thereby actuating the lever 13p fixed to the intermediate portion of the connecting rod 13o turnably supported on the main plate 7a and underplate 7b of the main table 7. The slide 13a is then moved past the lever 13q fixed to the upper end of the connecting rod 13o by the rod 13r making a connection between the lever 13q and the slide 13a, whereby the bending die 13g is moved toward the core bar 10a during coiling to reduce the coil diameter. It is again noted that the geometry of the coil diameter is adjustable by the adjust screw 13s for moving the stroke adjusting block 13l interposed between the auxiliary lever 13m and the main lever 13j while slidingly fitted into the auxiliary lever 13m and the adjust screw 13t threadedly engaged with the connecting screw rod 13n.

Figure 14:
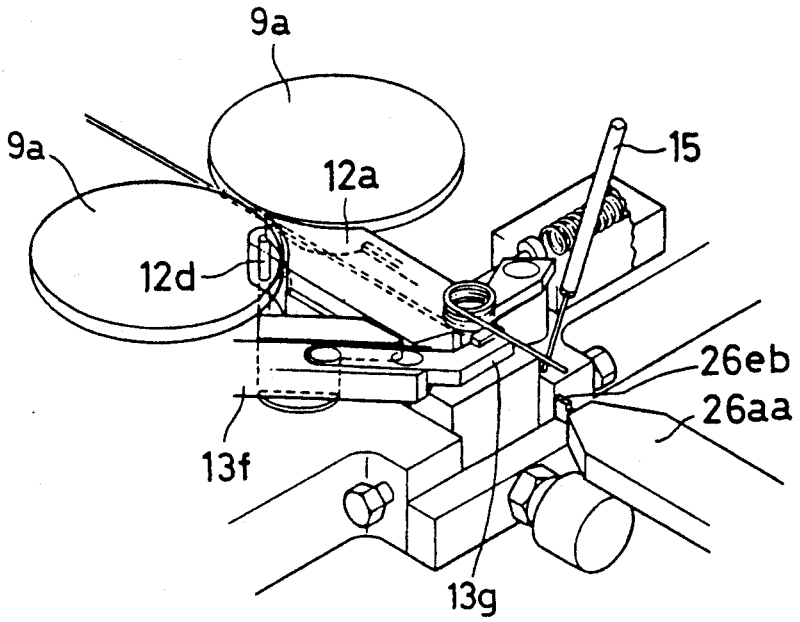
FIG. 14 to 17 are perspective views illustrating the coiling process at the coiling section.
Figure 15:
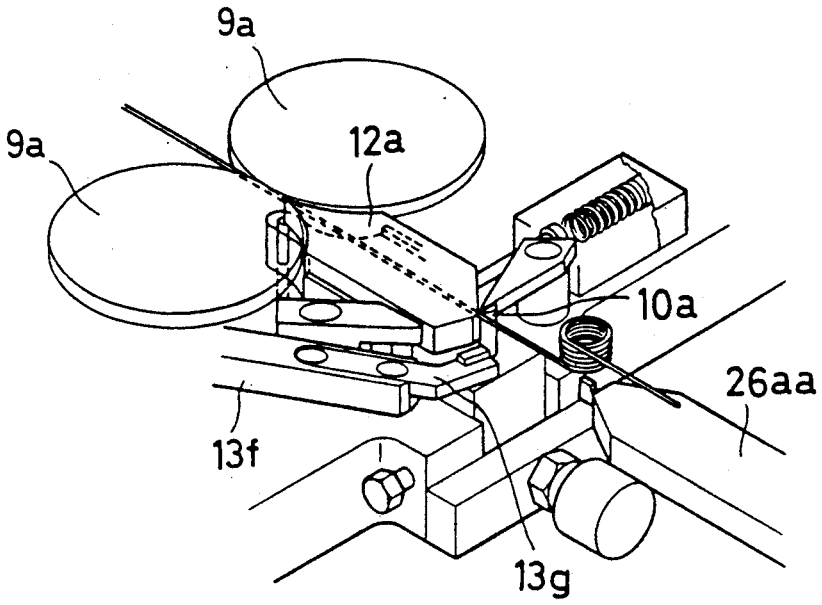
Figure 16:
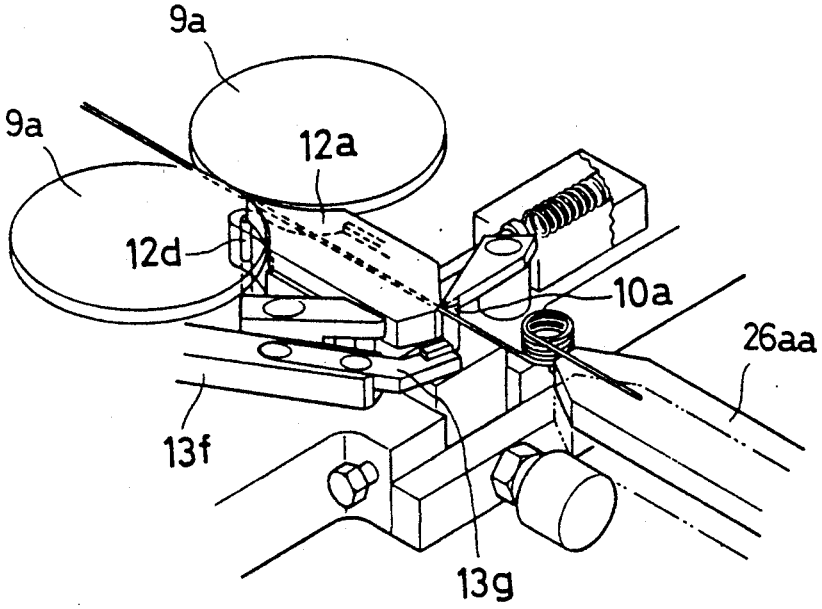
Figure 17:
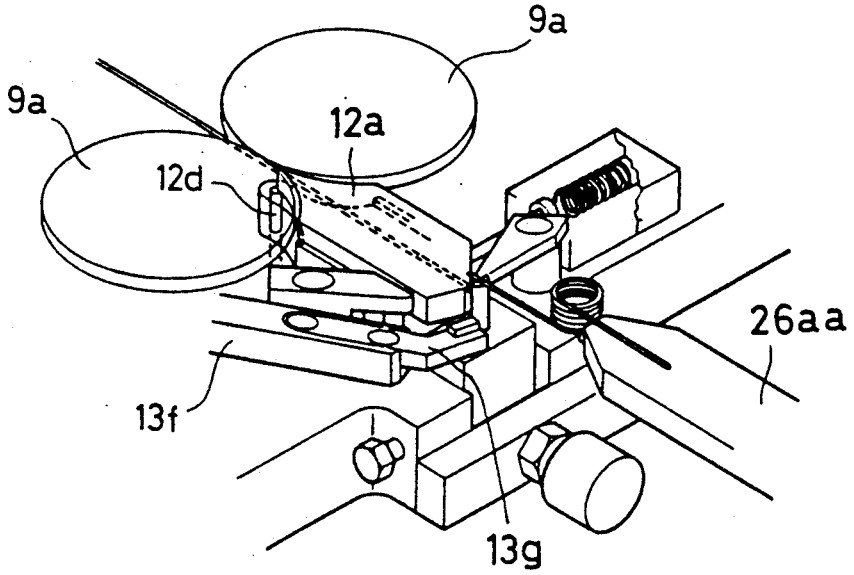

A bending die actuating mechanism, shown generally at 14, is provided to move the bending die 13g to a position where it abuts upon the wire for coiling. As illustrated in FIG. 7, the arm 13dc of the bending die table 13 is connected within a slot 13aa formed in a lever 14a pivotally supported on the shaft 14b fixed to the main plate 7a of the main table 7 by means of a connecting rod 14c threadedly provided at its both ends with rod ends 14d and 14e, and a lever 14f fixed to a boss portion of the lever 14a forming a junction with respect to a shaft 14b is pulled by a tension coiled spring 14h in such a way that a follower mounted at its extreme end abuts upon an upper end portion of the main shaft 8e. Thus, the levers 14f and 14a rock at the given timing of a cam 14g, so that the arm 13dc of the bending die 13d is pulled through the connecting rod 14c, turning the bending die table 13d around the vertical shaft 13e in the counterclockwise direction. Thus, the bending die 13g screwed to the arm 13db is engaged with the wire fed out through the feed rollers 9a, forming the coiled portion. In this manner, by the time the bending die 13g is engaged with the wire, a portion of the wire fed out without engagement with the bending die 13g provides an arm end from which coiling starts. Subsequently upon the termination of the operation of the cam 14g, the lever 14f is pulled back by the tension coiled spring 14h, permitting the lever 14f to rotate the arm 13c of the bending die table 13d around the vertical shaft 13e in the clockwise direction. Thereupon, since the bending die 13g departs from the line along which the wire is fed out, as shown in FIG. 15, the wire is fed out straightforward, thus providing a second arm end at which coiling is to terminate. At the final point of time of forming the coiled portion, the servomotor 9b is stopped by bringing a contact sensor 15 for controlling the angle of coiling in contact with the second arm end of the coiled portion, as illustrated in FIG. 14, thereby stopping the wire feeding to control the orthogonal angle between the leading and terminating arm ends. In this case, the amount of movement of the bending die 13g is regulatable in accordance with the magnitude of the diameter of the coils to be formed by regulating the rod ends 14d and 14e threadedly provided at both ends of the connecting rods 14c, i.e., adjusting the position of connection of the arm 13dc of the bending die 13d with the rod end 14e and the position of connection of the rod end 14d within the slot in the lever 14a. As illustrated in FIG. 7, the lever 14f may be located at the position illustrated, when forming dextrally coiled springs. When forming sinistrally coiled springs, however, the lever 14f is fixed at such a position for the lever 14f as shown by a dotted line and the tension coiled spring 14h is relocated at such a position as shown at 14h'.

Referring again to the structure of the bending die operating mechanism 14, the arm 13dc of the bending die table 13d to which the bending die 13g is fixed, the lever 14f pivotally supported on the shaft 14b fixed to the main plate 7a of the main table 7 and having its extreme follower pulled into abutment upon the cam 14g fixed to the upper end of the main shaft 8e, and the slot 14aa formed in the lever 14a fixed at the boss portion are connected with one another by means of the connecting rod 14c threadedly provided at its both end with the rod ends 14d and 14e. With the levers 14f and 14a pivotally rocked at the given timing of the cam 14g, the arm 13dc of the bending die 13d is pulled through the connecting rod 14c, so that the bending die table 13d is turned around the vertical shaft 13e. Thus, the bending die 13g is moved to a position where it is engaged with the wire fed out through the feed rollers 9a for cooling and to a position where the wire departs from the line along which the wire is fed out for the accomplishment of coiling and forming of the leading or terminating arm end. At the final point of time of coiling, the servomotor 9b is stopped by bringing the contact sensor 15 for controlling the angle of coiling in contact with the first or leading and terminating arm ends, so that the feeding of the wire is stopped to control the orthogonal angle between both the arm ends. The rod ends 14d and 14e threadedly provided at both ends of the connecting rod 14c are adjusted to regulate the position of connection of the arm 13dc of the bending die table 13d with the rod end 14e and the position of connection of the rod end 14d within the slot 14aa in the lever 14a, whereby the amount of movement of the bending die 13g can be regulated in accordance with the magnitude of the diameter of the coil to be formed.

As detailed above, the constitutional elements of the coiling section according to the present invention are substantially similar to those of conventional die types of coiling machines, and are not largely different therefrom in how the coiled springs are formed and they are handled. However, the apparatus of the present invention is characterized in that the coiled springs are formed with their axes kept vertical and the movable tables of the coiling section are movable to any transversely or horizontally desired position with respect to the framework 1 and fixed at the position in such a manner that the coiled springs formed are directly gripped with the pick-up units 26 of the adjacent progressive forming section to be referred to later.

Reference will now be made to the progressive forming section fixed at a position adjacent to the coiling section, in which the coiled spring formed at the coiling section at given timing is gripped in place to process at least one of the ends of the coiled spring, as formed, into any desired shape.

The progressive forming section illustrated uses an index drive unit 16 in which the number of clockwise indexing of the roller gear type is eighth (8) and the angle of indexing is 90°. The pick-up unit 26 is provided to take hold of the coiled springs formed at the coiling section for their progressive feeding. This unit is designed to be already on standby at the first stage in the middle of the process of coiling, with its grip kept open upwardly.

The index drive unit, shown generally at 16, has its input shaft 16a driven by power transmitted from within the framework 1 by way of a geared pulley 17 and a timing belt 18. A vertical flange type of output shaft 16b is rotated by power from the input shaft 16a, and is fixedly provided with a progressive head 19 defining the center of the progressive forming section. The progressive head 19 is provided therearound with eight (8) sets of pick-up units 26 at eight (8) radially equidistant positions to take hold of the coiled springs, as will be described later. THe coiled springs formed at the coiling section are progressively gripped by such 8 sets of pick-up units 26, form which they are progressively fed to the required forming steps to obtain various configurations of coiled spring products. The first stage is that the pick-up unit 26 which is located nearest the coiling section and by which the coiled spring is first gripped.

A head for attachment, shown generally shown at 20, is fixed in place by a beam 22 laid between two support posts 21 standing upright on the framework 1, as illustrated in FIG. 1, so as to provide therearound the auxiliary outfits required for forming at each stage, and also serves as a covering for the progressive head 19.

Figure 18:
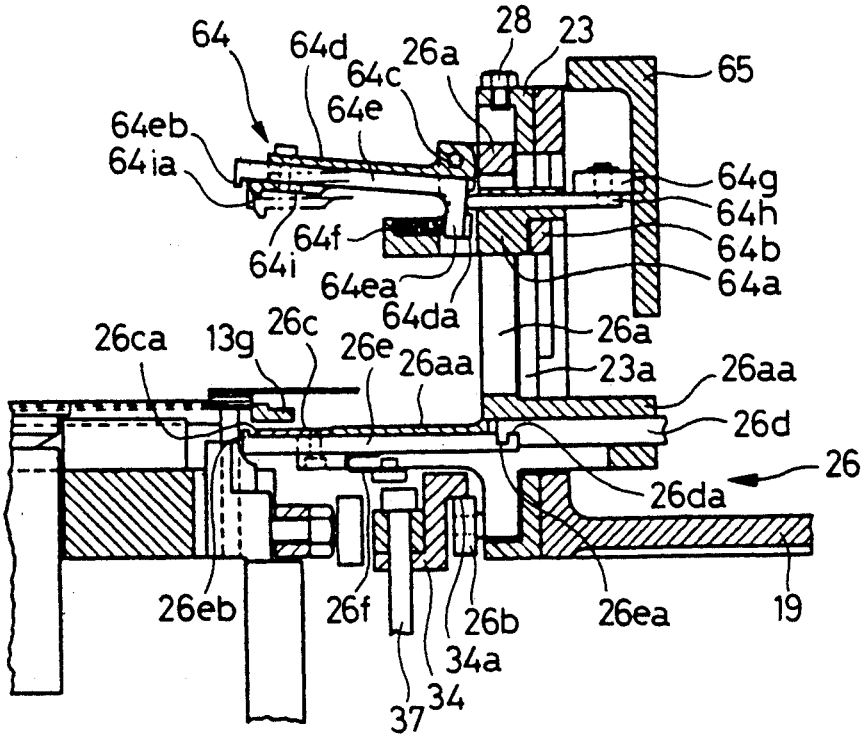
FIG. 18 is a front section showing the structure of the pick-up unit and upper grip unit of the progressive forming unit.
Figure 19:
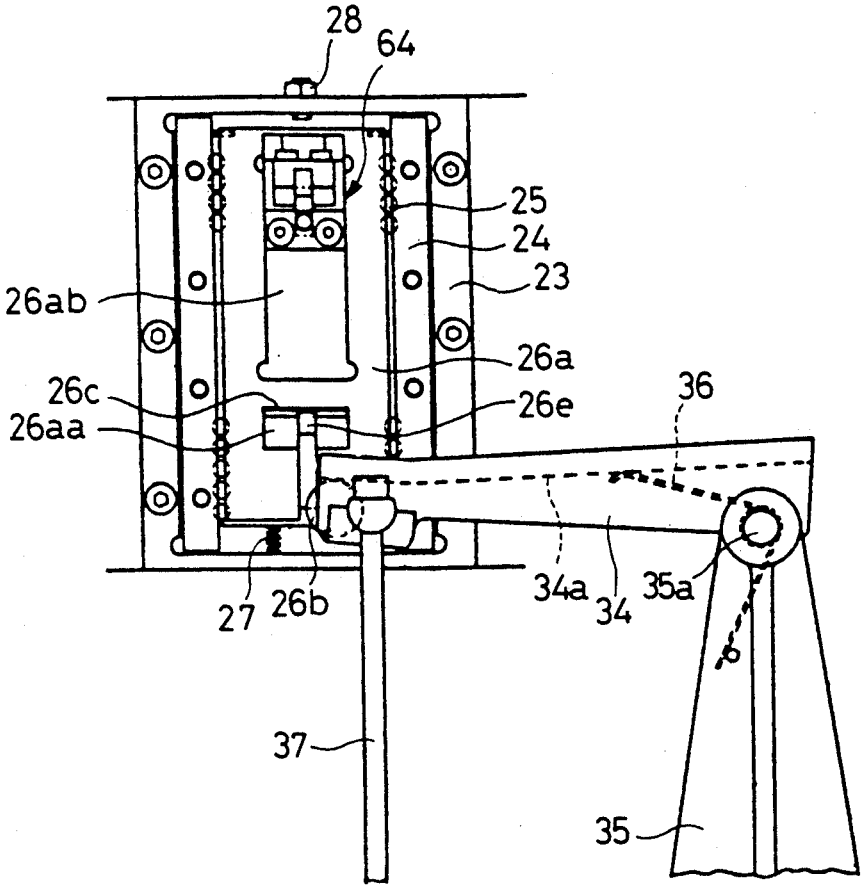
FIG. 19 is a left-hand side view of FIG. 18.
Figure 20:
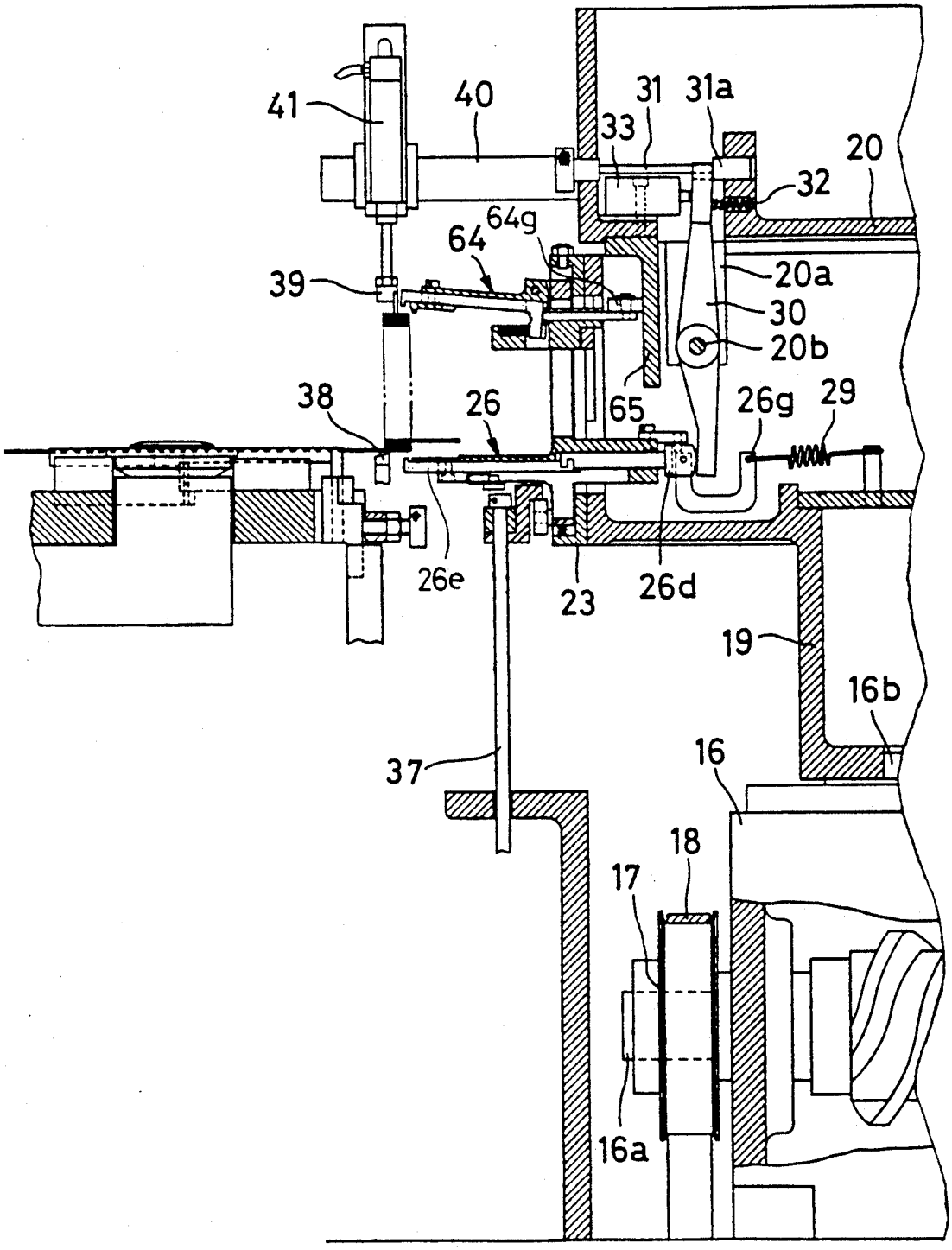
FIG. 20 is a front section illustrating the first stage portion of the progressive forming section.

A holder table 23 is screwed around the progressive head 19. As illustrated in FIG. 19, each or the pick-up unit 26 is head on cross roller rails 24 by cross rollers 25 for vertical movement, and includes a body 26a constantly engaged upwardly by a compression coiled spring 27 mounted in a lower portion of the holder table 23. As illustrated in FIG. 18, a roller 26b mounted in a lower portion of the body 26 is kept against upward movement by a flat cam 34 to be described later, and is located at its normal position upon engagement with a lower end of a stopper 28 threadedly provided into an upper portion of the holder table 23. Integrally provided to the pick-up unit body 26a is a horizontally extending arm 26aa, which extends through a vertical slide portion formed in the holder table 23 with its central extension line being in coincidence with the axis of the output shaft 16b of the index drive unit 16. Screwed to a front end of the arm 26aa is a cartridge 26c having its front end face 26ca disposed at right angle with respect to the central line of the arm 26aa. The terminating end of the coiled spring is gripped between the front end face 26ca of the cartridge 26c and a lug 26eb of a grip tool 26e precisely set below the central line of the arm 26aa of the pick-up body 26a, as will be described later. That is to say, a through-hole is provided through a rear portion, facing the progressive head 19, of the arm 26aa of the pick-up body 26a, and receives therein a spindle 26d, an end of which is fixedly provided with a U-shaped fitting 26g pulled by a tension coiled spring 29, as illustrated in FIG. 20. The front end lug 26eb is movably inserted through a rectangular groove formed in a notch 26da formed in an extreme end of the spindle 26d and located in front of and below the central line of the arm 26aa of the pick-up body 26a, as illustrated in FIG. 18, and faces the front end face 26ca of the cartridge 26c. That lug 26eb is also locked in a notch 26ea formed in a rear end of the grip tool 26e having its upper face located on the central line of the arm 26aa of the pick-up body 26a by means of a leaf spring 26f. Several types of lugs 26eb are to be formed at the front end of the grip tool 26e in dependence upon the diameters of the coiled springs and wires to be gripped, and are thus easily replaceable by the removal of the leaf spring 26f. A shaft 20b is mounted on an arm 20a extending from the lower portion of the head 20 for attachment, and is rockingly provided with a lever 30 which is constantly spaced at its lower end 2 to 3 mm away from the axial end of the spindle 26d by force of a compression coiled spring 32, as illustrated in FIG. 20. The lever 30 is provided in its upper end with a U-shaped groove which loosely receives an adjust screw rod 31. With air fed into a pneumatic cylinder 33 in response to a signal generated at given timing, the lever 30 is pushed by its piston rod and rotated around the shaft 20b. Thereupon, the lower end of the lever 30 gives a push to the spindle 26d, causing the grip tool 26e to be pushed with its extreme lug 26eb being moved away from the front end face 26ca of the cartridge 26c, thereby opening the grip for the coiled spring. The amount of movement of the lug 26eb of the grip tool 26e in the coiled spring gripping section is limited by a position at which the lever 30 is engaged at its upper end with a stopper 31a of the adjust screw rod 31, and is thus adjustable by the turning of the adjust screw rod 31. In the embodiment illustrated, mechanisms for opening or closing the grips of the pick-up units 26 work at the 8th, 1st and 2nd stages alone. That is, at the 1st stage the grip is designed to be opened or closed to take hold of the formed coiled spring. At the second stage, the grip is designed to be opened or closed when the angle of the coiled spring to be gripped at the first stage is varied in consideration of a possibility that inconvenience may be experienced for forming occurring at the third stage due to the arrangement of the forming unit. The coiled spring remains gripped for the 3rd to 7th stages. At the 8th stage, the grip is opened or closed to release the coiled spring subjected to forming.

Figure 21:
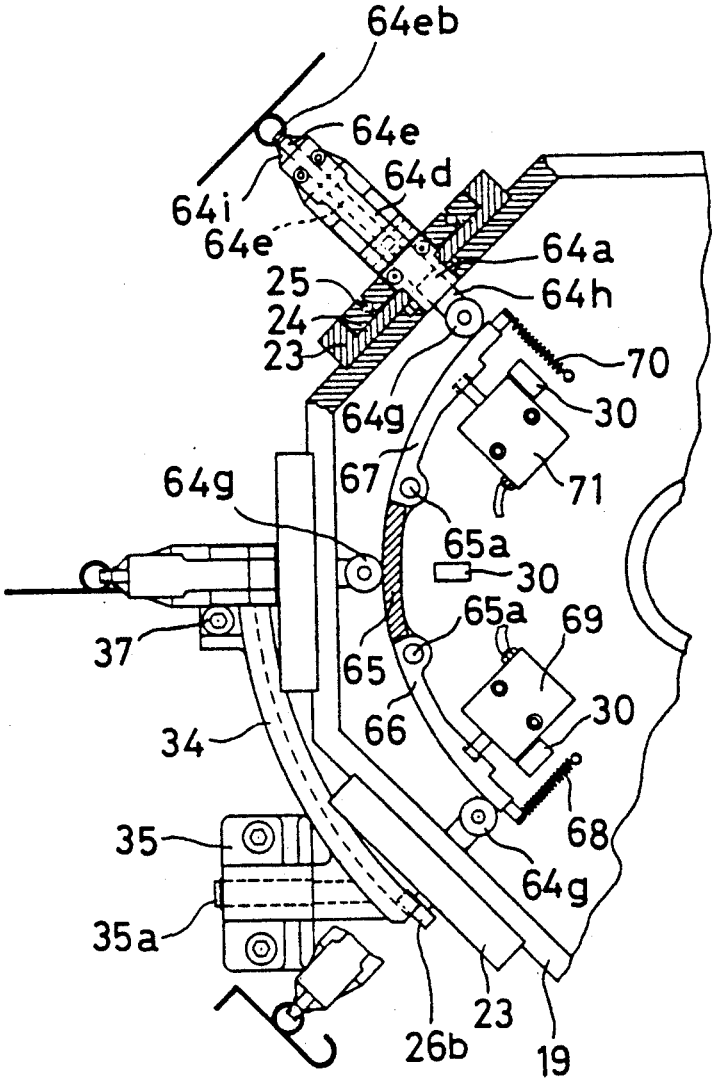
FIG. 21 is a plan view, partly sectioned, illustrating the upper grip unit in operation on each of the 8th, 1st and 2nd stage portions.

As illustrated in FIGS. 18, 19 and 21, the flat cam 34 is supported by a shaft 35a provided to a support post 35, so that its lower guide face 34a is positioned 2 to 3 mm away from the roller 26b of the pick-up unit 26 immediately on an orbital face along which that roller 26b moves in the 8th stage to the 1st stage, and a connecting rod connected to an extreme end of the flat cam 34 is pulled up by the torque of a torsion spring 36 mounted on the shaft 35a. The connecting rod 37 is operable such that the flat cam 34 is pulled down by the predetermined amount in response to the action at given timing of a cam equipped with the power transmission mechanism within the framework 1 against the torque of the torsion spring 36, thereby tilting the flat cam 34 down or pulling it back to horizontal. That is, just prior to the progressive feeding of the coiled spring with the pick-up unit 26, the flat cam 34 is kept horizontal, but it is pulled and tilted down just after the initiation of such progressive feeding and at the point of time when the roller 26 positioned at the first stage disengages the flat cam 34. Thus, the pick-up unit 26 being progressively fed at the eighth stage is pushed down by the predetermined amount until the roller 26b comes to the first stage, while regulated by the flat cam 34. This is because since the lower end of the formed coiled spring (the terminating end of the coiled portion) is to be gripped from below the pick-up unit 26, the grip of the pick-up unit 26 has to be located below the bending die 13g so as to prevent their contact. For instance, the pick-up unit 26 may be pushed down from the normal position (the progressive feeding position) through a distance of about 9 mm. Upon the pick-up unit 26 reaching the first stage in this manner, the pneumatic cylinder 33, shown in FIG. 20, is operable to actuate the lever 30 in response to the predetermined signal to give a push to the spindle 26d of the pick-up unit 26, thus disengaging the extreme lug 26eb of the grip tool 26e from the front end face 26ca of the cartridge 26c to open the grip.

At the point of time when coiling is completed at the coiling section, the coiled portion of the coiled spring is positioned just above the open grip of the pick-up unit 26. The extreme end of the flat cam 34 is then released from being regulated by the action at given timing of the cam equipped with the power transmission mechanism within the framework 1, so that it moves up by the predetermined amount under the torque of the coiled spring 36, while the open grip of the pick-up unit 26 moves to a position where it is capable of taking hold of both ends of the coiled spring and temporarily stops there. Upon subsequent interruption of the action of the pneumatic cylinder 33 in response to the predetermined signal, the lever 30 is pulled back by force of the compression coiled spring 32 with its lower end disengaging the axial end of the spindle 26d, whereupon the grip of the pick-up unit 26 is closed by force of tension coiled spring 29. The terminating end of the coiled spring is then gripped between the front end face 26ca of the cartridge 26c and the lug 26eb of the grip tool 26e, immdediately after which the arm of the terminating end is cut off between the core bar 10a and the wire guide 12a.

Next, the flat cam 34 is released from being regulated at the given timing of the cam within the framework 1 and pulled back to a horizontal state by the torque of the torsion coiled spring 36. While the pick-up unit 26 keeps hold of the terminating end of the coiled spring product thus cut-off, it goes up through a distance of about 3 mm under the force of the compression coiled spring 27, shown in FIG. 19, and is engaged with the stopper 28 located above the holder table 23, wherefrom it returns to the normal position and is then progressively fed to the second stage.

In the event that the terminating end of the coiled spring has an excessively long arm or coiled portion when it is gripped at the first stage, a spring bearing 38 is first located just below the coiled portion of the coiled spring, as shown in FIG. 20, and a triangular metal fitting 39 mounted at an extreme end of a piston rod of a pnuematic cylinder 41 attached to a support post 40 screwed to an outer wall of the head 20 for attachment is then located in slight abutment just upon the coiled portion. In this manner, the accuracy of gripping with the pick-up unit 26 is maintained.

An upper grip unit 64 attached to an upper portion of the pick-up unit 26, as shown in FIG. 20 is used in intending to take hold of an upper end of the coiled portion of the coiled spring, as will be described later.

Figure 22:
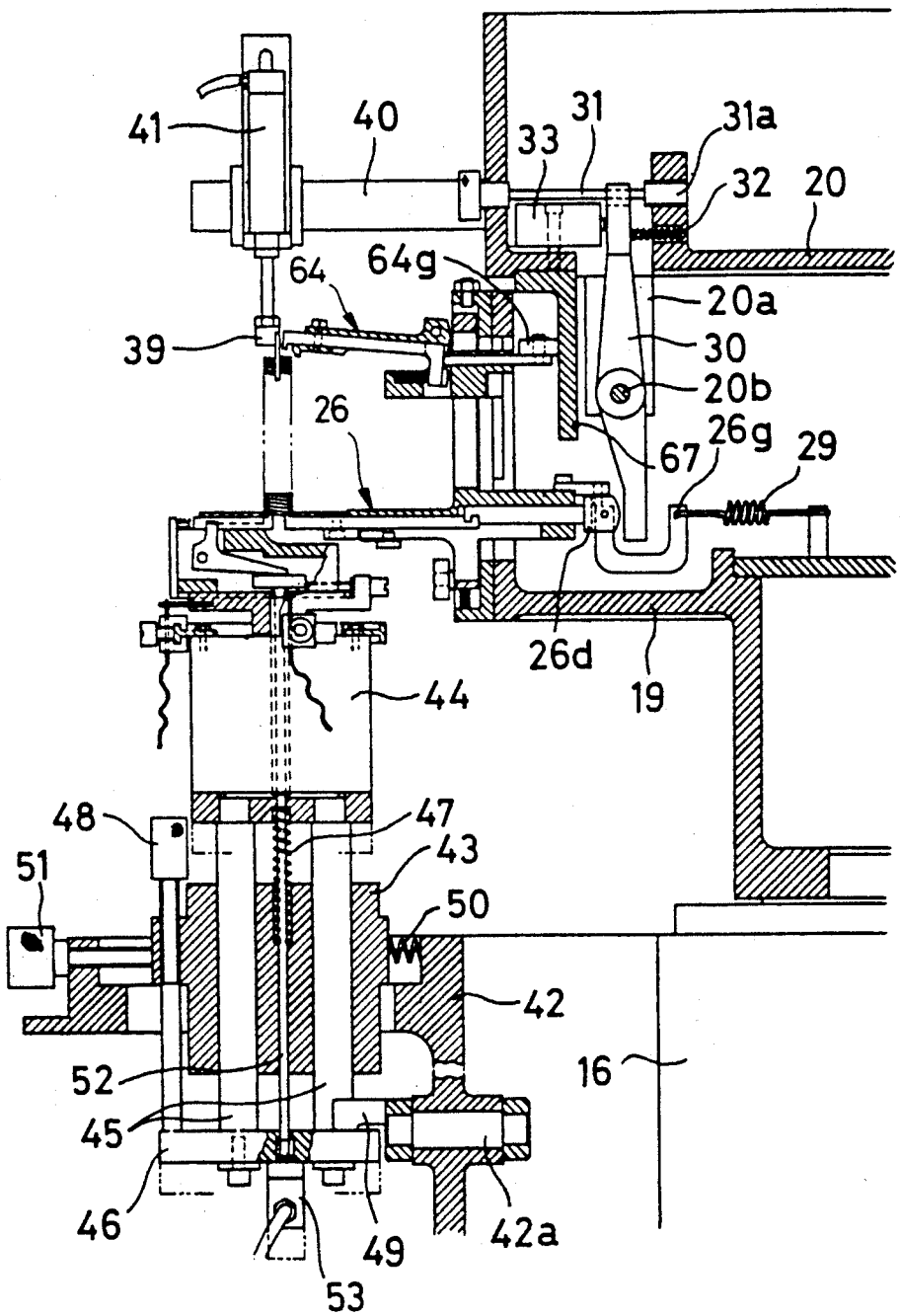
FIG. 22 is a sectional view showing the second stage portion at the progressive forming section.
Figure 23:
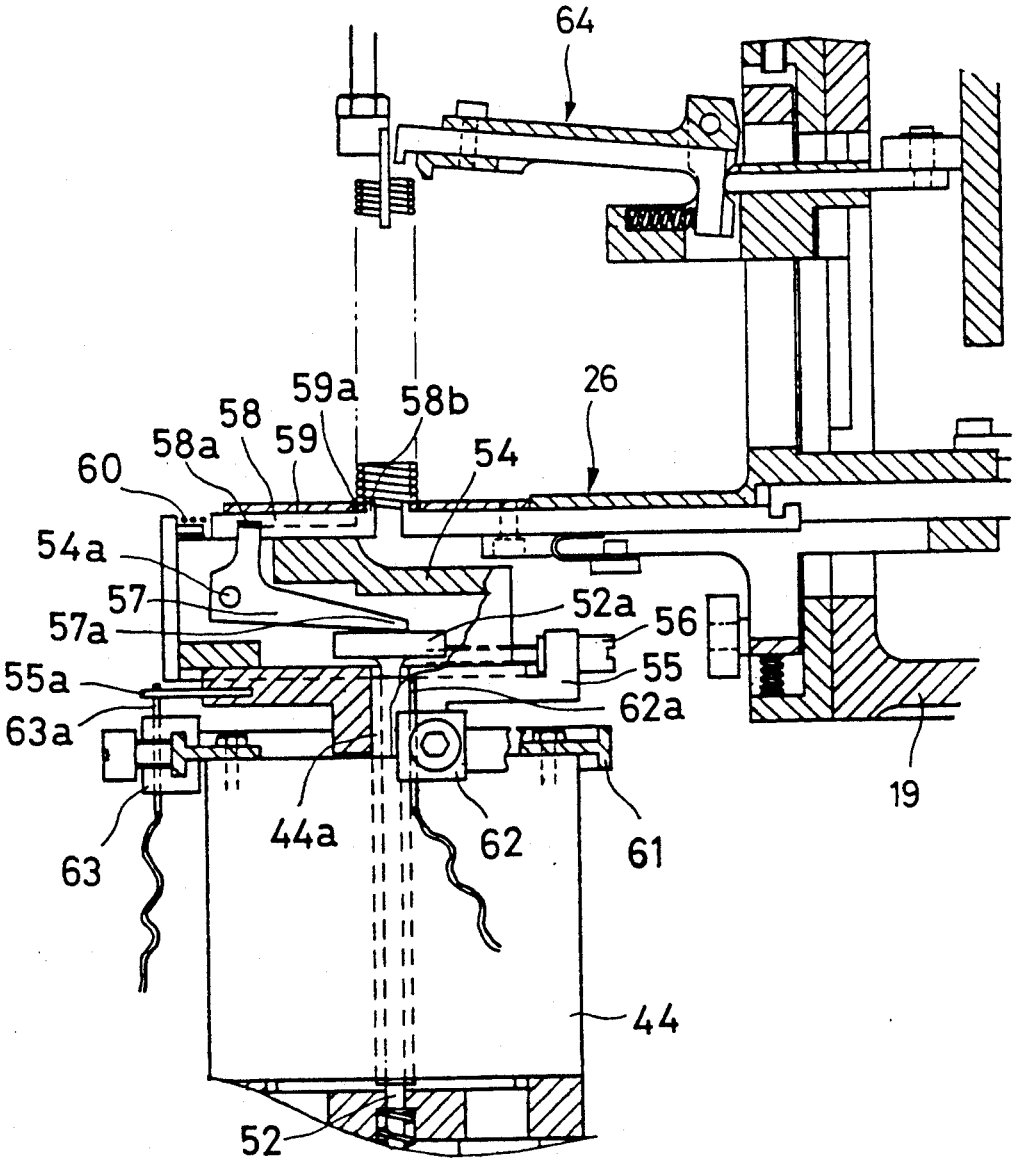
FIG. 23 is an enlarged sectional view of FIG. 22.
Figure 24:
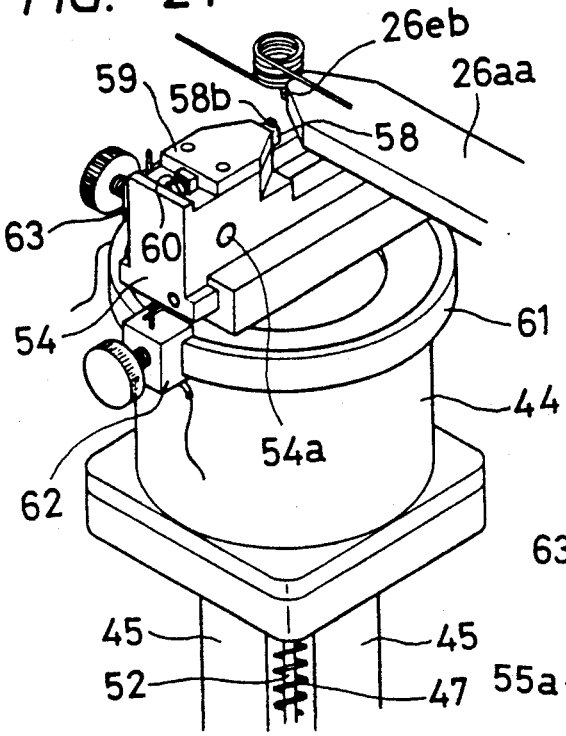
FIGS. 24 to 26 are perspective views illustrating the process of taking separate hold of a coiled spring.
Figure 26:
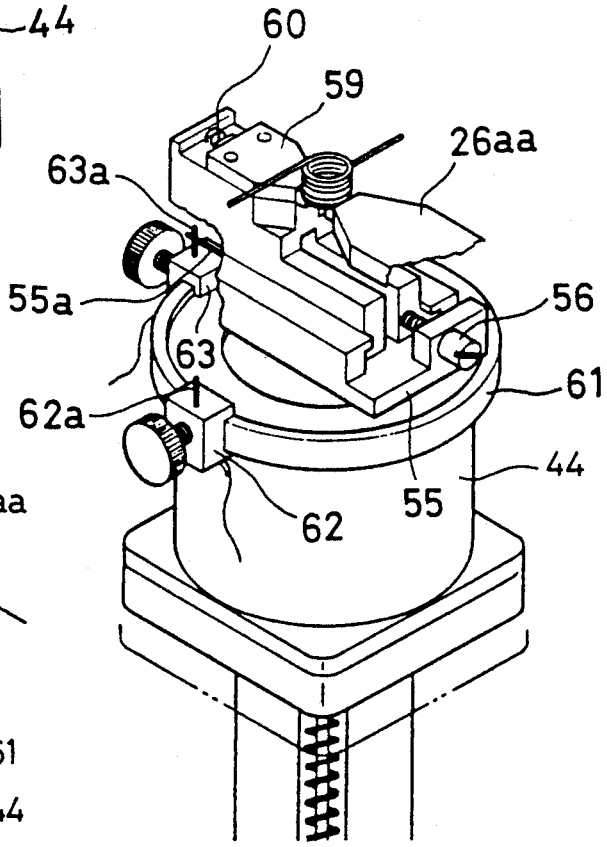
Figure 25:
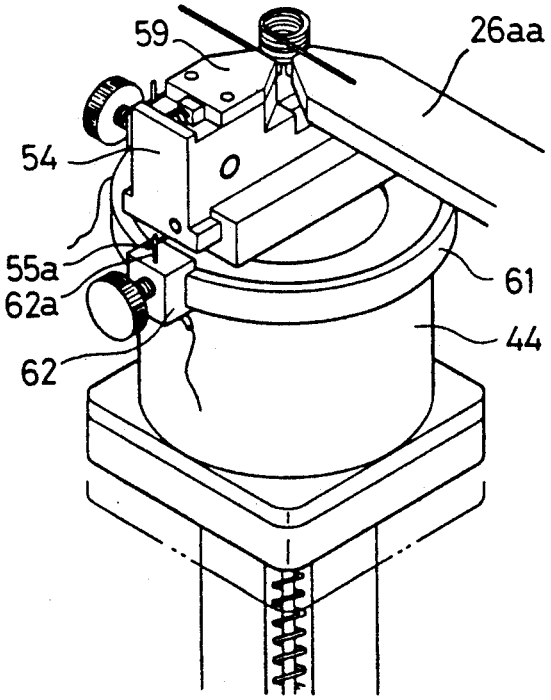

An arched forming bed 42 is arranged around the output shaft 16b of the index drive unit 16, and is provided with a slide 43 or 72a just below the central line of the pick-up unit 26 adapted to stop at the stages except at the 1st and 8th stages. Referring to this state in the second stage by way of example as shown in FIG. 22 the slide 43 is constantly urged outwardly by force of a compression coiled spring 50 and regulated in terms of its position by an adjust screw 51. (The slide 72a used at the second and subsequent stages will be explained later). Two spindles 45, whose lower ends are fixed to a metal fitting 46, extend vertically and slidably through the slide 43 at the second stage, and are provided at their upper ends with a stepping motor 44 with its output shaft 44a turned upward. The stepping motor 44 is constantly pushed up by force of a compression coiled spring 47 interposed between it and the slide 43, and is regulated in terms of its height by an adjust screw 48 which is in threaded engagement with the slide 43 and has its extreme end engaged with the fitting 46. A lever 49 pivotally supported on a shaft 42a fixed to halfway through the forming bed 42 is pulled down, when the metal fitting 46 is pushed down by the action at given timing of the cam equipped with the power transmission mechanism within the framework 1 against the force of the compression coiled spring 47. In other words, the stepping motor 44 is vertically movable at the given timing through a distance of about 10 mm. As illustrated in FIG. 22, the output shaft 44a of the stepping motor 44 has therethorugh an axially hollow portion, through which a spindle 52 extends. The spindle 52 is located at its lower end on the axial end of the piston rod of the pneumatic cylinder 53 fixed to the metal fitting 56, and is provided at its upper end with a T-shaped head 52a which is positioned at a central portion within a grip block 54 movably supported such that it is regulated with an adjust screw 56 at a desired position on a holder table 55 fixed to the output shaft 44a of the stepping motor 44. An L-shaped lever 57 is pivotally supported on a shaft 54a fixed to the grip block 54, and is located at its one end 57 *a* on an upper face of the T-shaped head 52a of the spindle 52. The L-shaped lever 57 is also slidably and precisely fitted at its other lug in a rectangular groove provided in an upper face of the grip block 54, and is fitted into a notch 58a in a grip tool 58 retained on the upper face of the grip block 54 by a cartridge 59 which also serves as a lid. The coiled spring is gripped between a front end face 59a of the cartridge 59 and a lug 58b of the grip tool 58. That is to say, since the grip tool 58 is constantly urged by force of the compression coiled spring 60 disposed at the rear end thereof, a grip defined between the front end face 59a of the cartridge 59 and the lug 58b of the grip tool 58 is kept open. However, as the pneumatic cylinder 53 is actuated in response to the predetermined signal to thrust up the spindle 52 and one end 57a of the L-shaped lever 57 on the face of the T-shaped head 52a by its piston rod, the lever 57 is swung around the shaft 54a to move the grip tool 58 against the force of the compression coiled spring 60, thereby closing the grip. In short, the pneumatic cylinder 53 is actuated at the given timing, thereby closing the grip to take hold of the coiled spring. Then, the feeding of compressed air to the pneumatic cylinder 53 is stopped to open the grip, thereby releasing the coiled spring from being gripped. The upper end of the spindle 52 is located on the T-shaped head 52a, because for the regulation of its position, the grip is allowed to be moved from the position coincident with the axis of the output shaft 44a of the stepping motor 44 by only a half of the maximum diameter of the coiled spring formed on the left side in FIG. 22. A main body of the stepping motor 44 is fixedly provided on its upper portion with a guide ring 61. To any suitable positions on the guide ring 61 are screwable insulators 62 and 63 fixedly provided with contact plug 62a and 63a for controlling (stopping) pulse signals for motor driving, which are in turn electrically connected with electronic controls housed within the framework 1, and the holder table 55 fixed to the output shaft 44a of the stepping motor 44 is provided at its one end with an earth rod 55a. Thus, the stepping motor 44 is repeatedly actuated or stopped, as illustrated in FIGS. 24 to 26, until it is actuated at given timing in response to forward or backward signals to bring the earth rod 55a in contact with the contact pin 62a or 63a. In other words, the stepping motor 44 is forwardly or backwardly operable only through the set angle between the controlling pins 62a and 63a.

Referring to FIG. 24, the output shaft 44a of the stepping motor 44 is regulated by the adjust screw 51 to a position where its axis is in coincidence with the center of the coiled spring progressively fed to the second stage, and the section of the grip block 54 is regulated by the adjust screw 51 to a position where it is capable of taking hold of the coiled portion of the coiled spring (i.e., a position away from the axis of the output shaft 44a of the stepping motor 44 by a half of the coil at diameter. The progressively fed coiled spring is now positioned at the second stage, while the earth rod 55a contacts the controlling contact pin 62a with the grip of the grip block 54 kept open and pushed down from the normal position through a distance of about 10 mm. The operation of such a structure as mentioned above will now be explained from the point of time illustrated in FIG. 24. Since the lever 49 pivotally supported on the shaft 42a fixed to the intermediate portion of the forming bed 42 has already been subjected to the action at the given timing of the cam equipped with the power transmission mechanism within the framework 1, the metal fitting 46 allows the stepping motor 44 to be moved up through a distance of about 10 mm by force of the compression coiled spring 47, whereby the grip block 54 is moved up to close the grip for taking hold of the coiled spring, as illustrated in FIG. 25. At this state, the grip of the pick-up unit 26 is opened to move the coiled spring from the pick-up unit 26 to the grip block 54 for gripping. The stepping motor 44 is then actuated clockwisely to bring the earth rod 55a into contact with the controlling pin 63a screwed at an angle of about 90° with respect to the controlling contact pin 62a, whereupon the stepping motor 44 is stopped into a state shown in FIG. 26. Then, the grip of the pick-up unit 26 is closed to take hold of the coiled spring, while the grip of the grip block 54 is opened to move the grip block 54 down to the original position. Afterwards, the coiled spring is progressively fed to the third stage, during which the stepping motor 44 is reversed to relocate the earth rod 55a from the controlling contact pin 62a to the original position. If diamond abrasive grains are fixedly deposited by electroplating or brazing onto both the front end face 26ca of the cartridge 26c of the pick-up unit 26 for progressively feeding the coiled springs and the front end face 59a of the cartridge 59 of the grip block 54 of the second stage, it is then possible to take sure hold of the coiled springs by relatively limited force of the same grip member which causes the faces of the coiled springs to be securely gripped regardless of the magnitudes of the diameters of wires and coils or regardless of the coil being close- or pitch-coiled. That is, to take secure hold of coiled springs cannot be expected, unless the gripping face of the grip member is in coincidence with the contours of coiled springs. However, if diamond abrasive grains are fixedly deposited onto the gripping face of the grip member, it is possible to take secure hold of various coiled springs formed of a wire of up to 3 mm in diameter with a single jig, not only when their ends are held from inside and outside but also when their barrels are held from outside.

Referring then to such an upper grip unit 64, it is provided to take hold of an upper end of the coiled spring, when the coiled spring gripped by the pick-up unit 26 increases in the number of turns or is pitch-coiled with its coiled portion being unstable. This unit can be moved along the coil length of the coiled spring to be gripped along a vertical line of the pick-up unit 26 for positioning. A main body 64*a* of the upper grip unit 64 extends through a longitudinal window 26*ab* formed on the central line of the vertical slide provided on the pick-up unit body 26*a* as mentioned above and shown in FIG. 19, and is slidably fitted into the slot 23*a* vertically formed through the center of the holder table 23, as illustrated in FIG. 18, so that it is vertically movable and positioned in a precise manner by a T-shaped nut 64*ab* attachable or detachable by two bolts from both sides of a compression coiled spring 64*f*, as will be described later. The main body 64*a* includes an arm 64*d* supported for rocking movement by a pin 64*c* fitted into an upper portion thereof, and holds at its lower portion a compression coiled spring 64*f* for engagement with an extreme end of a right-angled hand 64*ea* of a grip tool 64*e* to be described later. Slidably held halfway between the pin 64*c* and the compression coiled spring 64*f* inward of the progressive feed head 19. The arm 64*d* is provided with a downward right-angled hand 64*da* on its side on which the pin 64*c* is mounted. The grip tool 64*e* is precisely and slidably fitted into a rectangular groove formed in a lower face of the arm 64*d* along its central line, and is supported by a cartridge 64*i* screwed to an extreme end of the arm 64*d* from its lower face. The grip tool 64*e includes a right-angled hand 64ea* similar to the right-angled hand 64*da* of the arm 64*d*, and is provided at its other end with a lug 64*eb* so as to take hold of the leading end of the coiled spring between the lug 64*eb* and a front end face 64*ia* of the cartridge 64*i*. In short, the right-angled hand 64*ea* of the grip tool 64*e* is urged at its lower end by force of the compression coiled spring 64*f*, as mentioned above, and one end of the pillar slide 64*h* is located on the right-angled 64*ea* on the side opposite to the compression coiled spring 64*f*. In the embodiment illustrated in FIG. 20, the roller 64*g* is guided by guide plates 64, 66 and 67 to be described later, and is then engaged with the right-angled hands 64*da* and 64*ea* of the grip tool 64*e* and arm 64*d* by the pillar 64*h*, so that the extreme ends of both the grip tool 64*e* and arm 64*d* remains lifted up to open the portion of the coil to be gripped.

The operation of such a structure from the point of time at which the pillar slide 64*h* pushed upon the guide plates 65 and 67 is pushed back will no be explained with reference to FIG. 21. The extreme ends of both the arm 64*d* and grip tool 64*e* are forced back to a horizontal state by force of the compression coiled spring 64*f*, so that the right-angled hand 64*da* of the arm 64*d* is engaged with the main body 64*a* and restored to the normal horizontal position. Upon the pillar slide 64 being further pulled down, only the grip tool 64*e* is moved right-handedly by force of the compression coiled spring 64*f*, while the arm 64*d* is kept at its original position, so that the grip is closed to take hold of the coiled spring. On the contrary, while the roller 64*g* is actuated in operative association with the guide plates 65 and 67 to move the pillar slide 64 in the left-handed direction, thereby pushing out the grip tool 64*e* alone, the arm 64*d* is kept horizontal by force of the compression coiled spring 64*f* acting on the right-angled hand 64*ea* under a deflecting load exerted by the action of the pillar slide 64*h* from the side opposite thereto, thereby opening the grip. Further left-hand movement of the pillar slide 64*h* gives a push to the right-angled hand 64*da* of the arm 64*d*, so that both the arm 64*d* and grip tool 64*e* are returned to their initial states where their extreme ends are lifted up around the pin 64*c*, while their grips are kept open.

For such operation, the guide plate 65 for guiding the roller 64*g* is screwed to the lower face of the first stage from the head 20 for attachment, and the guide plates 66 and 67 are respectively supported on the 8th and 2nd stages by shafts 65*a* fitted into its both ends for rocking movement. These guide plates 65, 66 and 67 are each formed into a curvature following the progressive feeding round orbit defined by the roller 64*g*. However, the guide plate 65 is screwed at a position where the roller 64*g* is constantly urged. The position of the guide plate 66 on the 8th stage side is regulated by force of a tension coiled spring 68 and the position of the piston of the pneumatic cylinder 69, while the position of the guide plate 67 on the 2nd stage side is similarly regulated by force of a tension coiled spring 70 and the position of a piston of a pneumatic cylinder 71.

Just after progressive feeding, the pneumatic cylinder 69 on the 8th stage side is not at work, so that the guide plate 66 is spaced away from the roller 64*g* by force of the tension coiled spring 68, the pneumatic cylinder 71 on the second stage side is actuated to urge the guide plate 67 against the force of the tension coiled spring 70 and the upper grip unit 64 of the second stage is lifted up. On the second stage, the angle of taking hold of the coiled spring is then varied, if required, as mentioned above. After the completion of changing that angle, the operation of the pneumatic cylinder 71 is brought to a halt in response to a signal generated at given timing to pull back the guide plate 67 by force of the tension coiled spring 70. Thus, the upper grip unit 64 reverts to its normal horizontal position where the coiled spring is gripped. On the eighth stage, on the other hand, the pneumatic cylinder 69 is actuated upon the completion of inspection of the parts of the coiled spring with its arms formed to bring the guide plate 66 in engagement with the roller 64*g* against the force of the tension coiled spring 68 for actuation. Thus, the grip of the upper grip unit 64 is opened to release the coiled spring from being gripped. Then, progressive feeding is resumed, during which the operation of the pneumatic cylinder 69 is brought to a halt in response to a signal generated at given timing, so that the guide plate 66 is pulled by force of the tension coiled spring 68 back to a position away from the roller 64*g*. Thereupon, the pneumatic cylinder 71 is actuated to engage the guide plate 67 with the roller 64*g* against the force of the tension coiled spring 70, so that the upper grip unit 64 reaching the second stage is lifted up to such an initial stage as shown in FIG. 20. In other words, while the upper grip unit 64 is lifted up on the eighth stage with its grip kept open, the coiled spring is released from being gripped and moves from the first stage to the second stage, where the coiled spring is picked up by the next pick-up unit 26 and gripped in place. This is because, in some cases, difficulty may be involved in holding the coiled spring by the upper grip unit 64 on the first stage depending upon the position of the arm of the leading end thereof. In such cases, it is required to change the position of or the angle of taking hold of the coiled spring on the second stage, as explained above.

While the thus gripped coiled spring moves from the third stage to the seventh stages, its end arms are formed into the predetermined shape. This will now be explained with reference to the following one of the examples.

Figure 27:
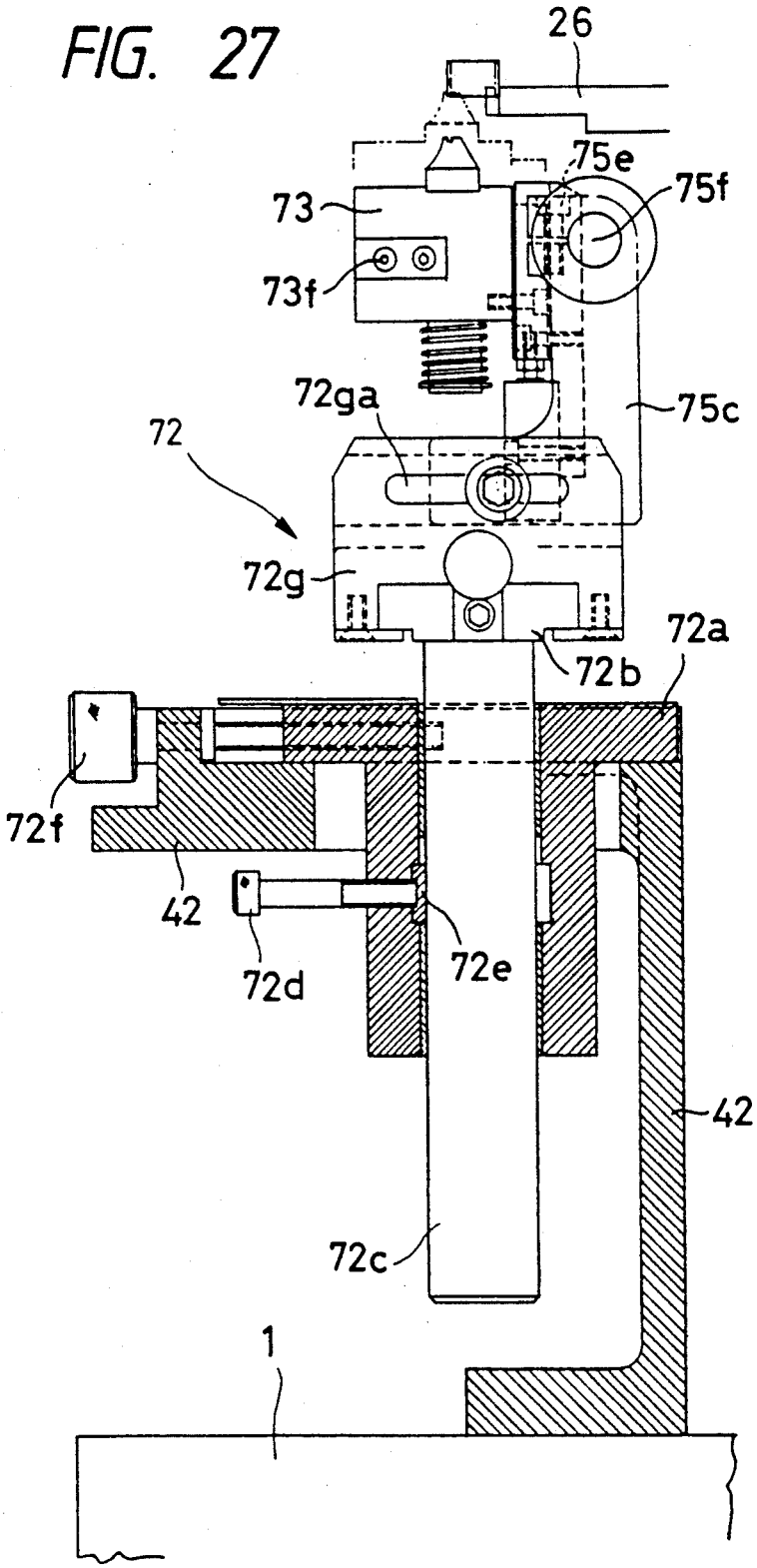
FIG. 27 is a partly sectioned view illustrating the structure of the forming stage.
Figure 28:
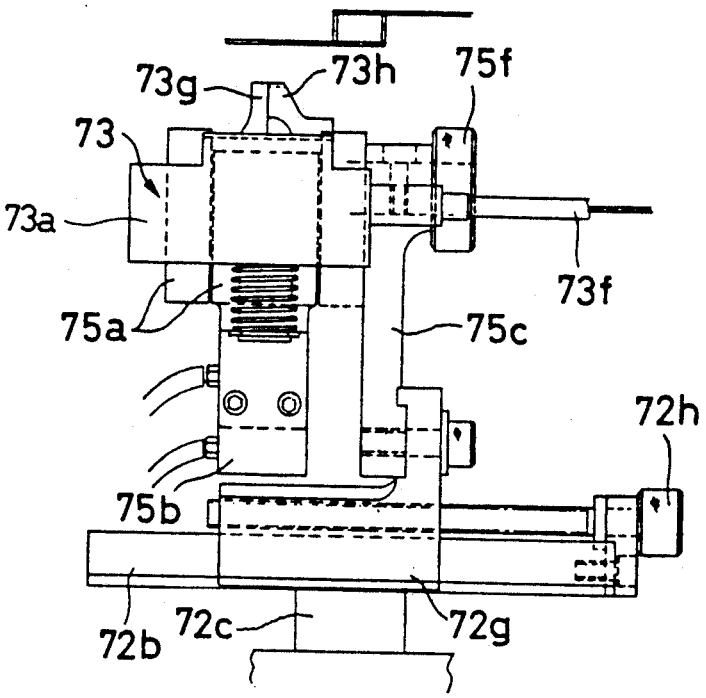
FIG. 28 is a left-hand side view of an upper portion of the forming stage.

A forming stage, shown generally at 72, includes a main slide 72*a* forming a main body thereof, which is disposed on the forming bed 42, as illustrated in FIGS. 27 and 28. Provided tranversely through a middle portion of the main slide 72*a* is a vertically movable and rotatable spindle 72*c* so as to locate a horizontal rail 72*b* fixed to its head at any desired height and angle. This spindle 72*c* is positioned and fixed by a clamp bolt 72*d* through a chip 72*e* for its surface protection. The center of the main slide 72*a*, viz., the axis of the spindle 72*c* is located just below the central line of the pick-up unit progressively fed to the stage, and is movable along that cental line and can be positioned by an adjust screw 72*f* at a position on a line leading to the axis of the output shaft 16*b* of the index drive unit 16, so that the axis of the spindle 72*c* coincides constantly with the coil axis of the coiled spring fed progressively. Movably engaged with the rail 72*b* on the spindle 72*c* is a slide 72*g*, which is movable to and which can be positioned at any desired position by an adjust screw 72*h*. The slide 72*g* is provided on its side with a slot 72*ga* to which are screwed a support arm 75*c*, 75*d* or 76*a* for supporting a linear way mechanism 75 or a snap ring mechanism 76 for supporting and moving a forming unit 73 or 74 to be described later. In the embodiment illustrated, identical forming stages are disposed from the third to seventh stages as the forming stages 72.

A forming unit 73 is provided to form the wire at a relatively small radius of curvature about twice the wire diameter, while a forming unit 74 is used to form the wire at a radius of curvature larger than that at which the wire is formed with the forming unit 73.

The forming units 73 and 74, linear way mechanism 75, snap ring mechanism 76 and the like to be described in what follows are parts which will be diversely modified and practically used by the experts, i.e. the users. Typical parts will now be explained with reference to the following embodiments.

Figure 29:
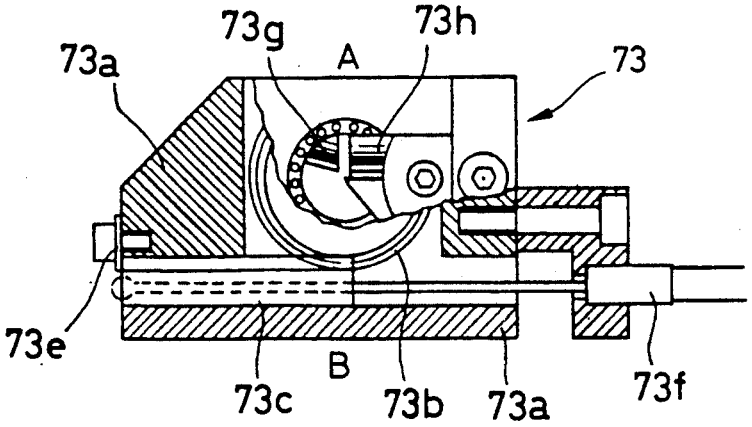
FIG. 29 is a plan view, partly sectioned, of a part of the forming stage.
Figure 30:
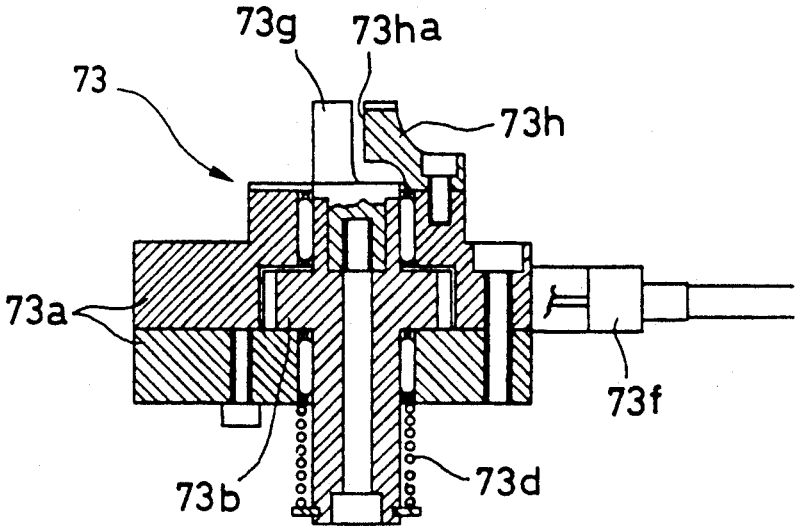
FIG. 30 is a longitudinally sectioned view illustrating the forming stage.
Figure 31:
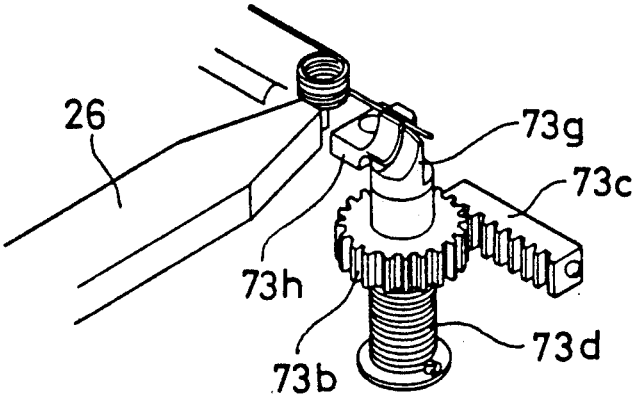
FIG. 31 to 32 are perspective views showing the process of forming the terminating end of the coiled spring with the forming units shown in FIGS. 29 and 30.
Figure 32:
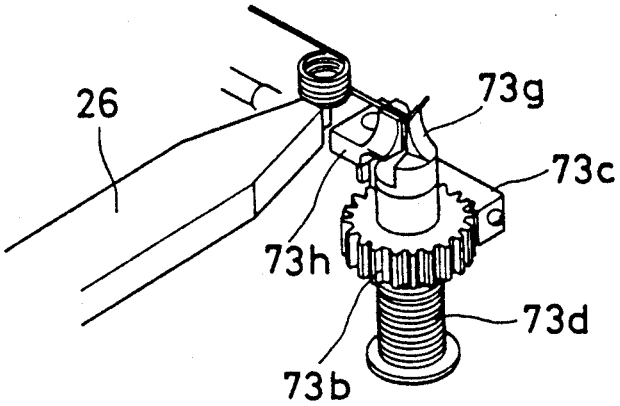
Figure 33:
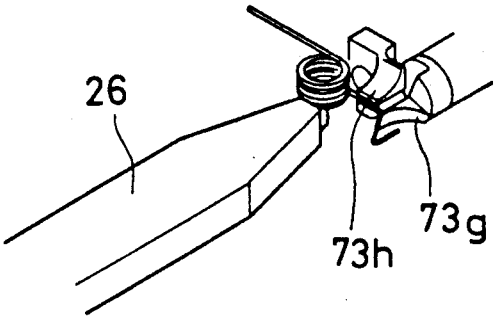
FIG. 33 is a perspective view showing the process of further forming the foiled spring formed in FIG. 32.
Figure 34:
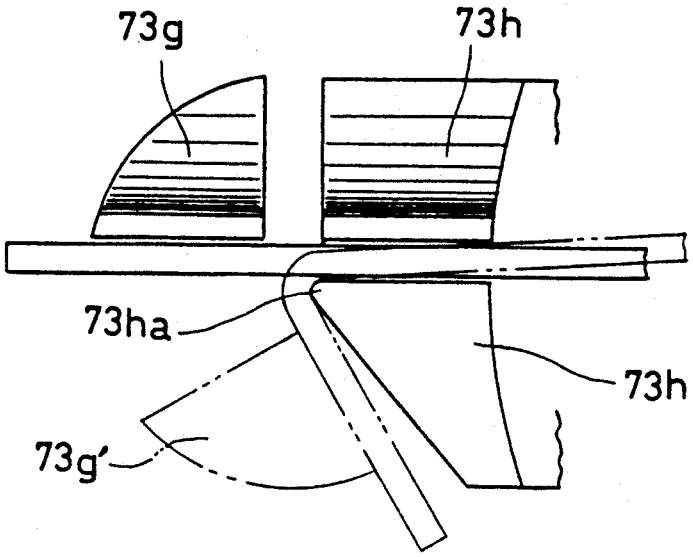
FIG. 34 is an enlarged view illustrating the tool at the forming unit.

In the main body 73*a* of the forming unit 73, as illustrated in FIGS. 29 and 30, a pinion 73*b* is supported in a rotatable and slidable manner with a rack 73*c* in mesh therewith. The rack 73*c* is engaged with a stopper 73*e* located on the left side in FIG. 25 by the torque of a torsion coiled spring 73*d* provided at an axial end of the pinion 73*b*. Connected to the rack 73*c* is a wire cable 73*f* connected to an operating mechanism comprising a cam and a lever within the framework 73*c* so that, with the wire cable 73*f* pulled, the pinion 73*b* rotates counterclockwise against the torque of the torsion coiled spring 73*d*. Screwed to an upper end of the pinion 73*b* is a bending tool 73*g* the shaft of which is cut out over ¾ of its length, as illustrated in FIGS. 29 and 34. Screwed to an upper face of the main body 73*a* is, on the other hand, an extreme end 73*ha* of a guide tool which is located in the vicinity of the axis of the pinion 73*b* and is provided therein with a groove for picking up the wire on the central line thereof (as will be described later). With the wire cable 73*f* pulled th rough the predetermined amount by the operating mechanism housed within the framework 1 as mentioned above, the arm of the coiled spring formed at the coiling section is bent only through the predetermined angle. The radius of curvature for such forming is then determined by the radius of curvature molded at the extreme end 73*ha* of the guide tool shown in FIG. 34. For use, the forming unit 73 of such a structure is screwed to the linear way mechanism 75 to be described later. As illustrated in FIG. 29, however, screwing is feasible on either faces A or B. In the embodiment illustrated, although the arm of the coiled spring formed at the coiling section is bent counterclockwise, there is additionally provided a unit for forming symmetrically coiled springs and bending their arms clockwise. As illustrated in FIGS. 31, 32 and 33, the coiled springs are progressively fed to the respective stages where they are repeatedly formed at the predetermined position in the predetermined direction.

Figure 35:
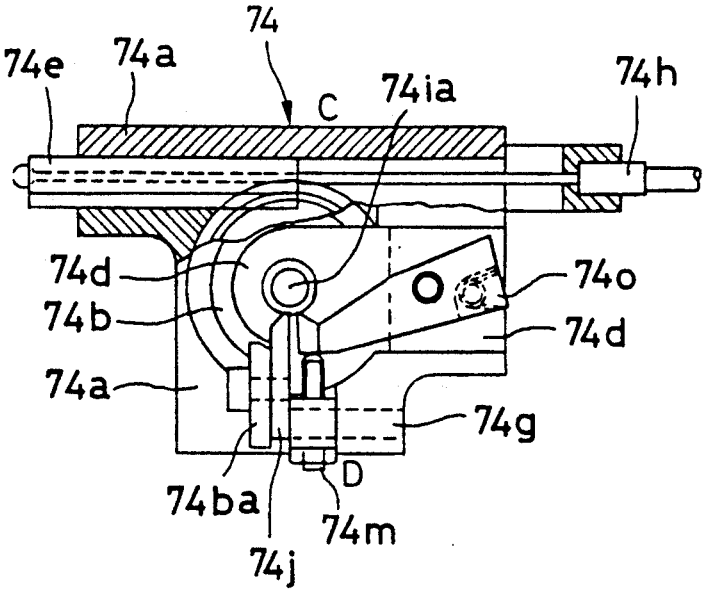
FIG. 35 is a plan view, partly sectioned, showing another forming unit.
Figure 36:
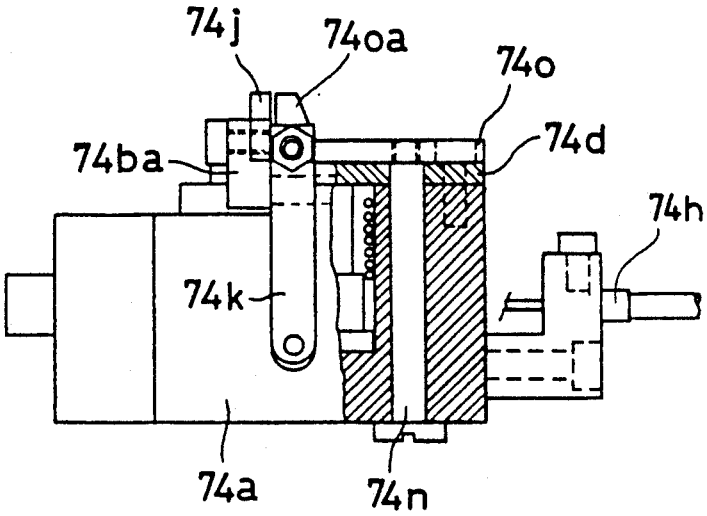
FIG. 36 is a partly sectioned plan view of FIG. 35.
Figure 37:
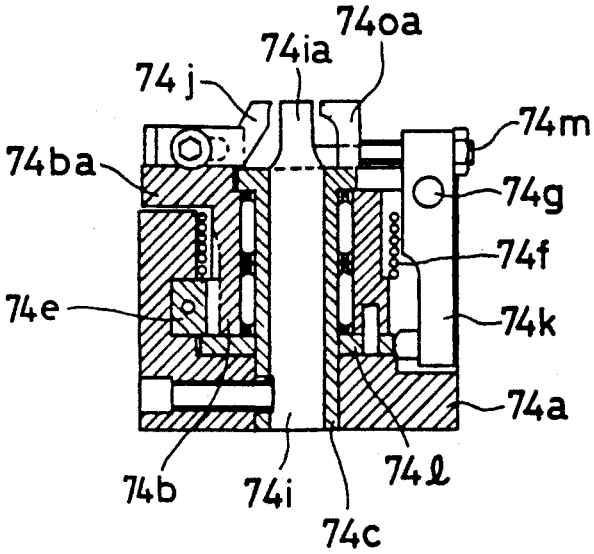
FIG. 37 is a partly sectioned front view of FIG. 35, FIGS. 38 to 41 are perspective views showing the process of forming the terminating end of the coiled spring with the forming units shown in FIGS. 35 to 37.
Figure 38:
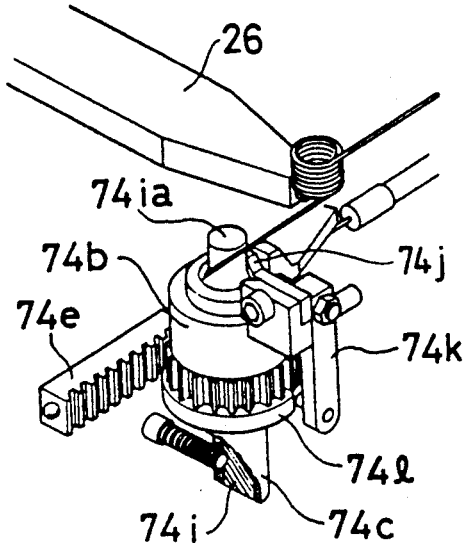
Figure 39:
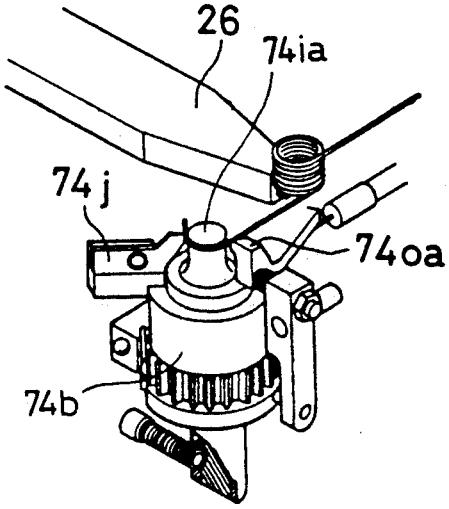
Figure 40:
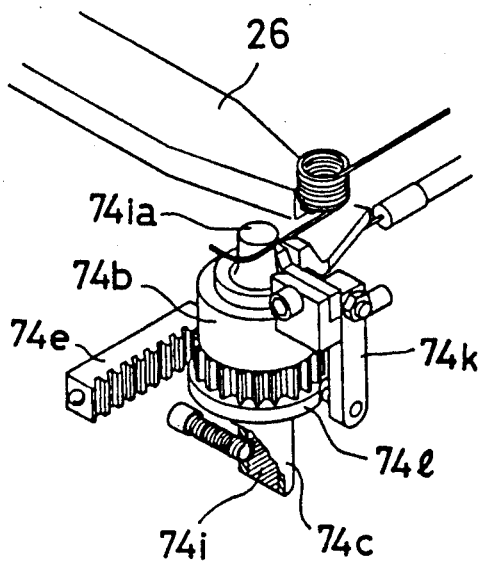
Figure 41:
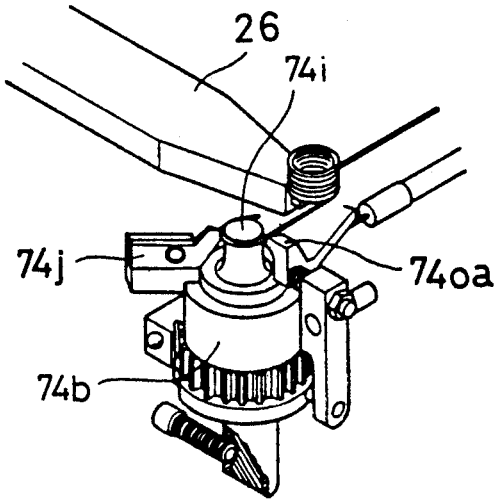

A main body 74*a* of the forming unit 74 includes a rotatably supported pinion 74*b*, a hollow shaft 74*c* provided with an upper end supporting plate 74*d*, which is fixed at its lower end as shown in FIG. 33, and a slidably held rack 74*e* which is in mesh with the pinion 74*b*. As shown in FIG. 37, the pinion 74*b* is engaged at its lug 74*ba* with a shaft 74*g* provided with the upper end supporting plate 74*d* by the torque of a torsion coiled spring 74*f* locked therearound. Locked to the rack 74*e* is, on the other hand, a wire cable 74*h* connected to the cam/lever-operating mechanism housed within the framework 1. With the wire cable 74*h* pulled by that operating mechanism, the pinion 74*b* is rotated through an angle of 180° against the torque of the torsion coiled spring 74*f*. Inserted and fixed through the hollow shaft 74*c* by a set screw is a core bar 74*a* which is detachable therefrom, if required. However, an extreme end 74*ia* of the core bar 74*a* is cut and molded into the desired later. As illustrated in FIG. 37, screwed into the slot in the lug 74*ba* of the pinion 74*b* is a bending die 74*j* in such a way that it is adjustably spaced away from the extreme end 74*ia* of the core bar 74*a* through a distance about 1.2 to 1.3 times larger than the diameter of the wire of the coiled spring to be formed. On the other hand, a lever 74*k* is rockingly fitted into the shaft 74*g* provided to the upper end supporting shaft 74*d*, and is engaged with an extreme end of a clamp lever 74*o* capable of rocking around a spindle 74*n* fitted into the upper end supporting plate 74*d* through an adjust screw 74*m* provided on the upper end of the core bar 74*i* of the pinion 74*b* under the action of a cam 74*l* fixed on a lower portion thereof, thereby gently clamping the wire of the coiled spring to be formed between its edge 74*oa* and the extreme end 74*ia* of the core bar 74*i*. The bending die 74*j* is first spaced away from the molded extreme end 74*ia* of the core bar 74*i* with the predetermined gap therebetween at a position adjacent to the edge 74*oa* of the clamp lever 74*o*, as illustrated in FIGS. 35 and 38. Upon the wire of the coiled spring to be formed being picked up through that gap, the pinion 74*b* starts to rotate clockwise under the action at given timing of the cam/lever-operating mechanism housed within the framework 1. Thereupon, the edge 74*oa* of the clamp lever 74*o* is first pushed by the cam 74*l* fixed on the lower portion of the pinion 74b through the lever 74k into engagement with the wire of the coiled spring, and the bending die 74j then causes the wire of the coiled spring to be guided along the molded extreme end 74ia of the core bar 74i, thereby forming the wire of the coiled spring at the desired radius of curvature. In this case, a bending force generated by the bending die 74j when the wire starts to be guided allows the edge 74oa of the clamp lever 74o opt bite into the wire of the coiled spring, thus providing non-skid function. If the die 74j is rotated through an angle of 180° or more, then the wire of the coiled spring already subjected to forming is pulled back and ill-shaped. For that reason, forming is shared by two stages, as shown in FIGS. 38 and 39 as well as FIGS. 40 and 41, thereby obtaining a coiled spring product of the desired geometry.

For use, the forming unit 74 is likewise screwed to the linear way mechanism 75 and the snap ring mechanism 76. However, screwing may be feasible on either one of faces C and D, as illustrated in FIG. 35. While the forming unit 74 according to the embodiment illustrated is provided to bend the wire of the coiled spring in a clockwise direction, there is provided an additional forming unit which is made symmetrically with respect to the forming unit 74 to bend the wire of the coiled spring in a counterclockwise direction.

Figure 42:
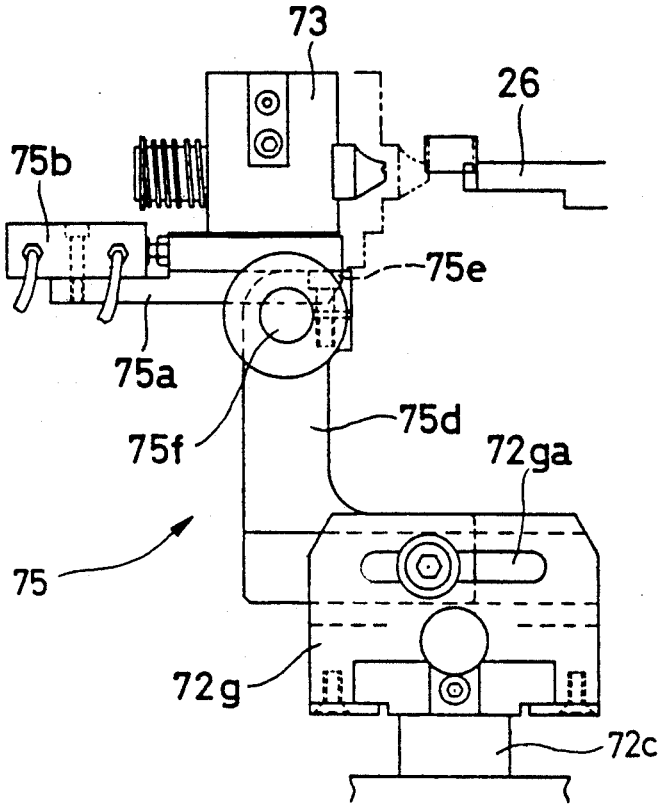
FIG. 42 is a front view showing the linear way mechanism.
Figure 43:
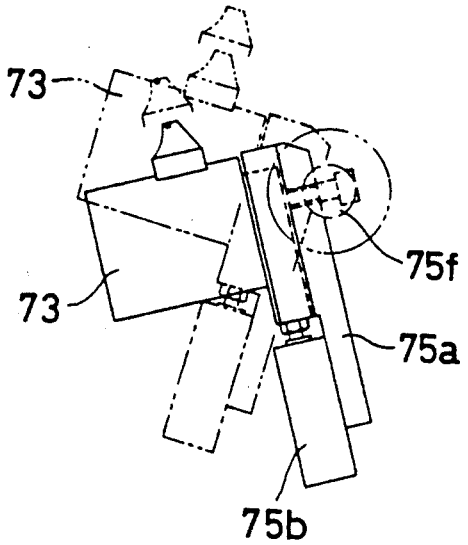
FIG. 43 is a view showing an angle provided in the linear way mechanism.

The linear way mechanism 75 includes a sliding unit 75a screwed to such a forming unit 73 or 74 to provide a linear reciprocating guide of the unit 73 or 74 through the predetermined distance. As illustrated in FIG. 27, the sliding unit 75a is fixed to a spindle 75a which is rotatably fitted into a support arm 75c, as shown in FIG. 42, and is fixed in place by a cap screw 75e, the support arm being screwed in place by a screw extending through the slot 72ga formed on the side of the slide 72g of such a forming stage 72 as illustrated in FIG. 27, so that it can guide the forming unit 73 or 74 set at any angle around the spindle 75f, as illustrated in FIG. 43. Primarily, the sliding unit 75a is provided to form the coiled spring from below or above. However, also provided is a support arm 75d which is made symmetrically with respect to the support arm 75c. If such a support arm 75d is used, it is then possible to form the coiled spring sideways and give an angle thereto, although kept horizontal in the embodiment illustrated. The forming unit 73 or 74 may then offer an obstacle to the progressive feeding of the coiled springs depending upon the angles of both arms of the coiled spring to be progressively fed. In such cases, the forming unit 73 or 74 is screwed to the snap ring 76 which, as will be described just below, is desired to be capable of forming the coiled spring sideways but offer no obstacle to the progressive feeding of the coiled springs by about 90°-rocking after forming.

Figure 44:
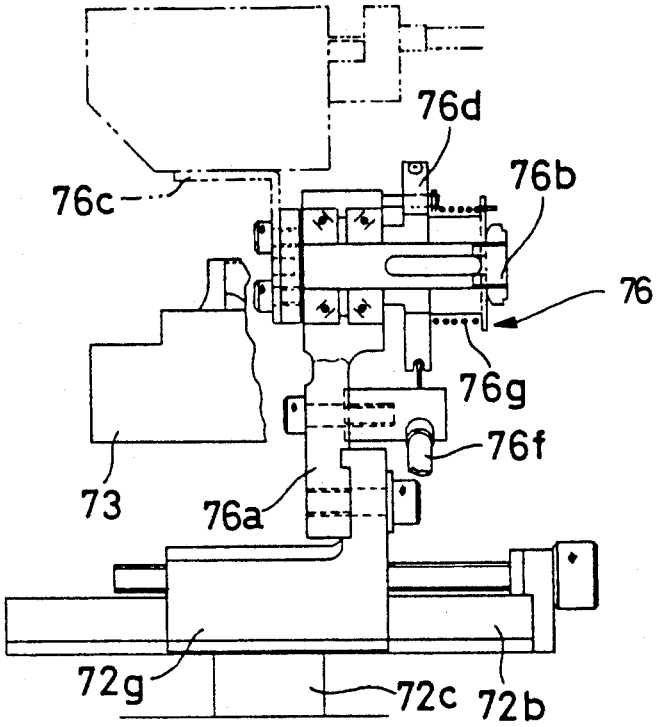
FIG. 44 is a front view showing the structure of the snap ring mechanism.
Figure 45:
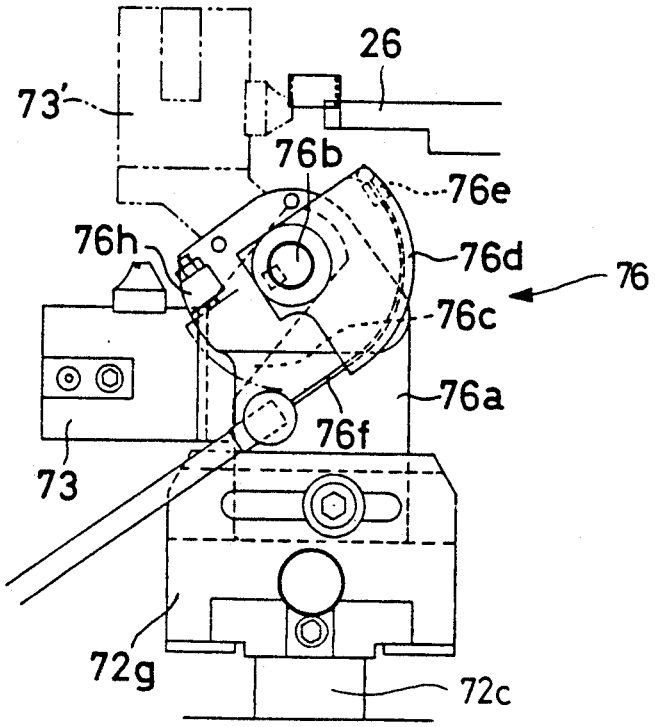
FIG. 45 is a plan view of FIG. 44.
Figure 46:
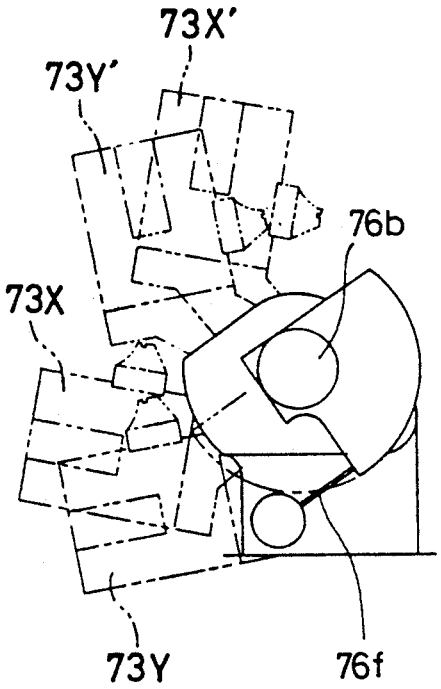
FIG. 46 is a view showing an angle provided in the snap ring mechanism.
Figure 47:
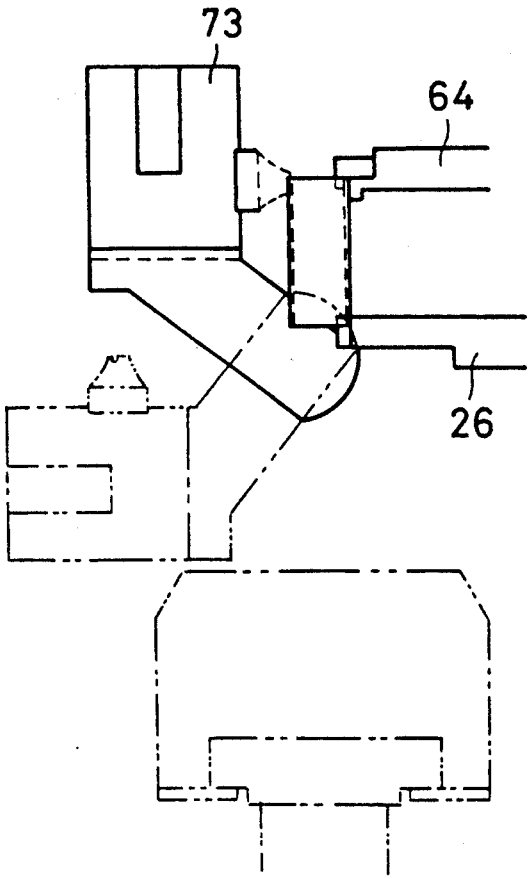
FIG. 47 is a view showing the limit of the snap ring mechanism with respect to the length of the coiled strength.

The snap ring mechanism 76 is designed to push out the forming unit 73 or 74 by about 90°-rocking so as to form the wire of the coiled spring vertically or at any angle of up to ±15° with respect to the vertical, eliminating any obstacle to the progressive feeding of the coiled springs with a rocking/pulling-back mechanism after the completion of forming. That is, the forming unit 73 or 74 (the forming unit 73 in the embodiment illustrated) is screwed to a hooked support plate 76c screwed to a spindle 76b rotatably fitted into a support arm 76a screwed in place, as illustrated in FIG. 45, by means of a screw extending through the slot 72ga in the slide 72g of such forming stage 72 as mentioned above. Locked to an operating arm 76d fixed to the spindle 76b through cushioning polyurethane 76e is one end of a wire cable 76f connected to the operating mechanism within the framework 1, and the operating arm 76d and forming unit 73 are rocked back to a position shown in FIG. 45 by the torque of a torsion coiled spring 76g disposed around the spindle 76b. However, with the wire cable 76f pulled in response to the predetermined timing of the operating mechanism within the framework 1, the operating arm 76d is engaged with the stopper 76h for the regulation of its position, so that the forming unit 73 is rocked up to a position 73' as shown in FIG. 45 to pick up the wire. In this case, the operating arm 76d is engaged with the stopper 76h, but the wire cable 76f is protected under the cushioning action of the polyurethane 76e, as already mentioned. If the angle of the hooked support plate 76c to be screwed to the spindle 76b, as shown in FIG. 44, when the wire of the coiled spring is formed at an angle rather than vertically, then the forming unit 73 can be changed from a position 73X to a position 73X' or from a position 73Y to a position 73Y'. Difficulty may be encountered in forming the leading end of the coiled spring, when the coiled portion is increased in length. In this case, use may be made of an upper forming stage 77 to be described later. In addition to a set of such a snap ring mechanism as mentioned above, there is provided an additional mechanism symmetrical with respect thereto so as to remove any obstacle to the attachment of the forming unit 73 or 74.

When using such a snap ring mechanism 76, the forming units 73 and 74 are used in the same manner as already mentioned. As stated in the foregoing, the main slide 72a is first moved by the adjust screw 72f to bring the axis of the spindle 72c of the rail 72b in coincidence with the axis of the coil of the coiled spring progressively fed to the stage thereof, as illustrated in FIG. 27, whereby the angle of the rail 72b is brought in parallel with the arm of the coiled spring to be formed and is regulated to and located at a height capable of picking up the wire of the coiled spring by the forming unit 73. Then, the slide 72g is moved by the adjust screw 72h and located at a position at which the coiled spring is to be formed, as illustrated in FIG. 28. Subsequently moved is the support arm 75c screwed by a screw extending through the slot 72ga in the slide 72g, which is in turn located according to the diameter of the wire of the coiled spring so as to pick it up. In this case, rapid positioning may be achievable by providing graduations on the slot 72ga of the main slide 72a, the slide 72g and slide 72g, although not illustrated.

Figure 48:
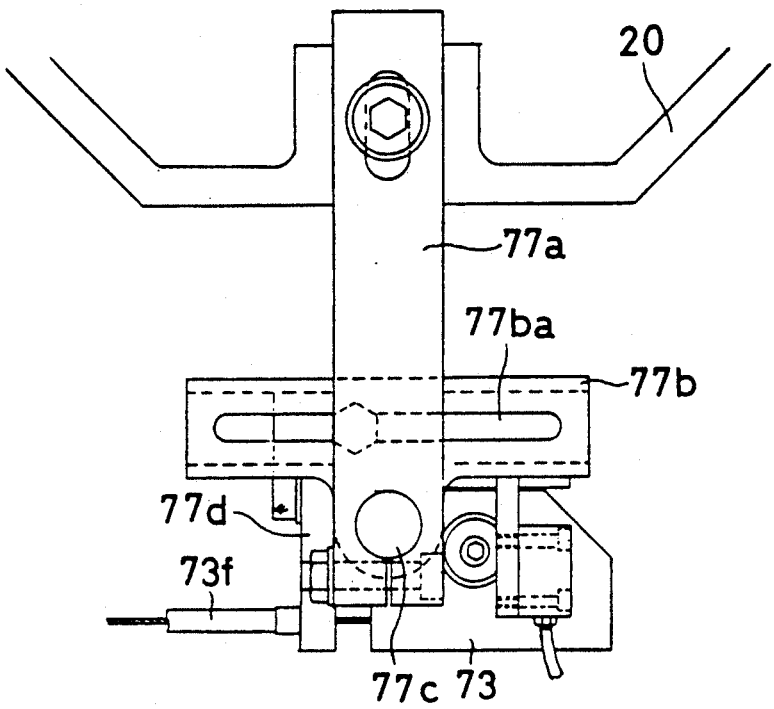
FIG. 48 is a plan view illustrating the upper forming stage to which the linear way mechanism is attached.
Figure 49:
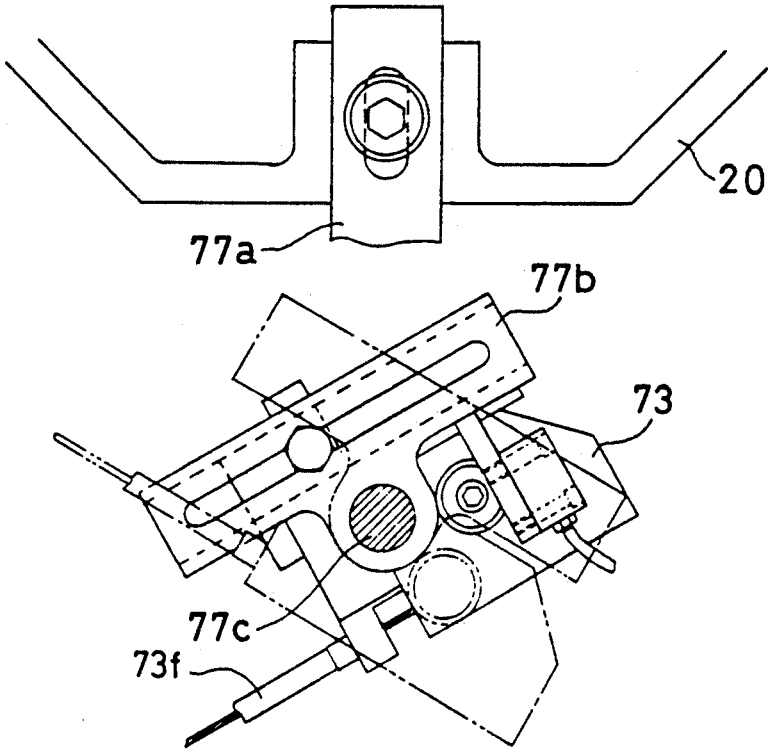
FIG. 49 is a view illustrating an angle provided on the upper forming stage.
Figure 51:
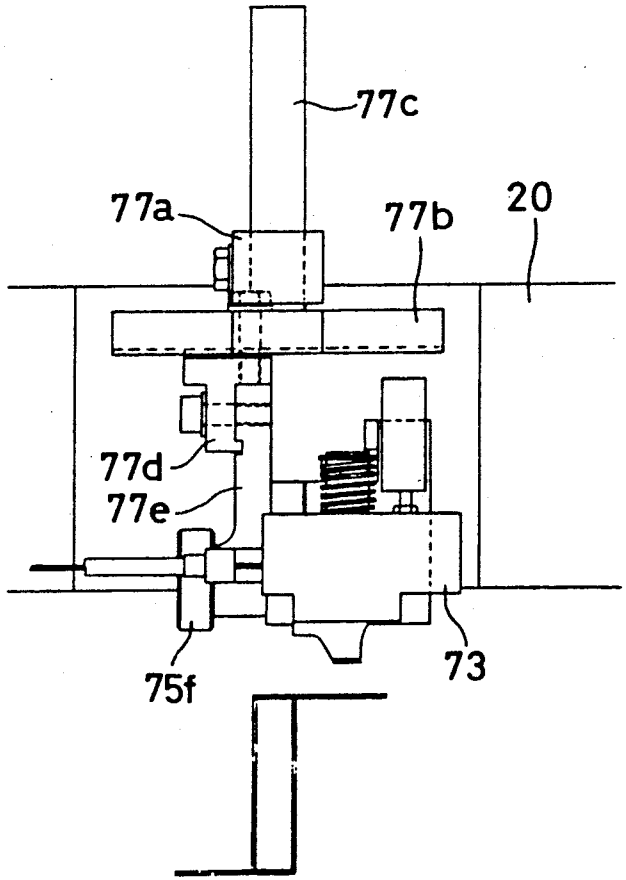
FIG. 51 is a front view showing the upper forming stage portion.
Figure 50:
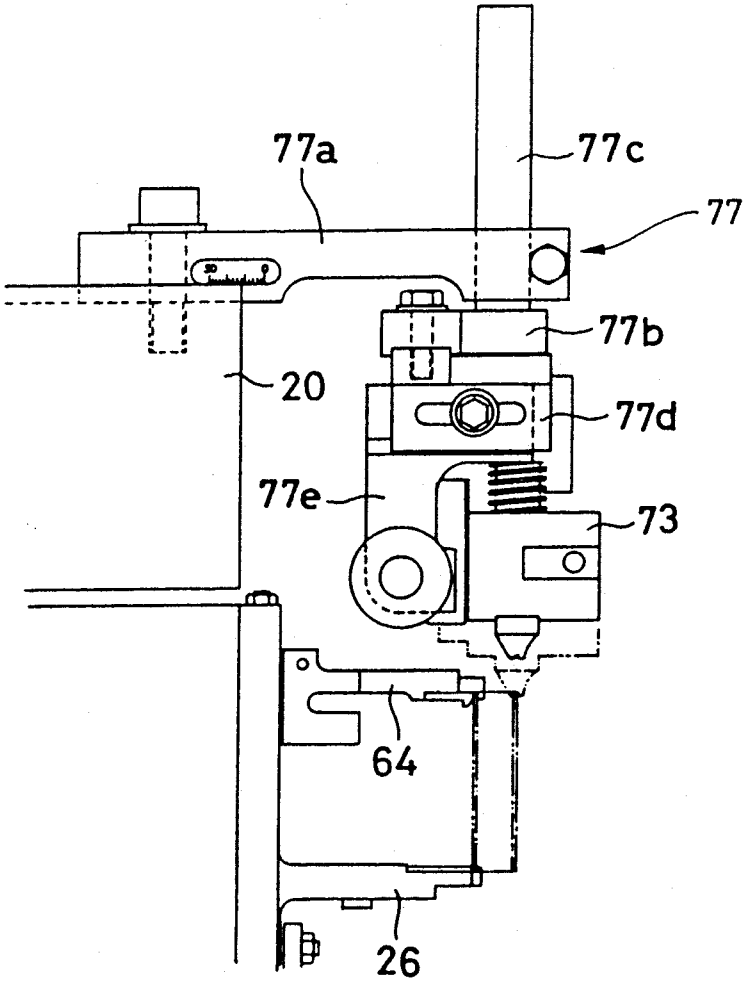
FIG. 50 is a view showing the left side of FIG. 48.
Figure 52:
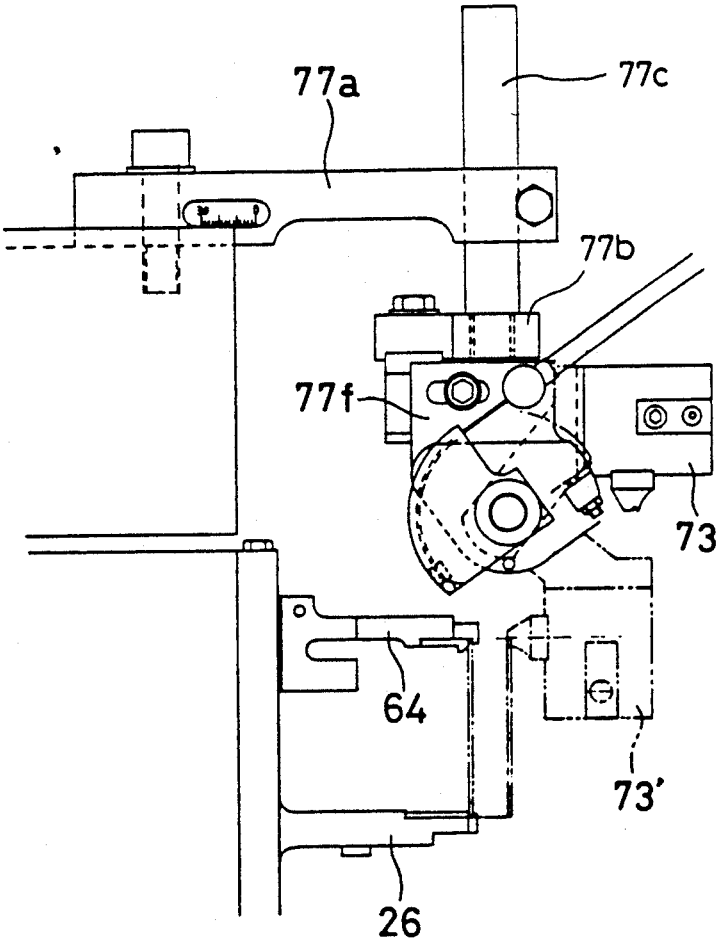
FIG. 52 is a plan view showing the upper forming stage to which the snap ring mechanism is attached.

The upper forming stage 77 is used to form the coiled spring formed at the coiling section from above, as already stated, and also serves as a cover for the progressive feed head 19. This may be screwed to any one of four stages from the third to sixth stages on the head 20 for attachment. Additionally, there is provided a mechanism which is simple but similar to that of the lower forming stage 72. In other words, the main arm 77a supporting the whole of the upper forming stage 77 is screwed within a guide groove in a slidable manner, as illustrated in FIGS. 48 and 49. At its extreme end, the spindle 77c fixed at its lower end to the guide plate 77b, as illustrated in FIGS. 50 and 51, is held and fixed at the predetermined angle and height by a bolt in a rotatable and vertically movable manner. The central line of the main arm 77a coinciding with the axis of the spindle 77c is made to coincide with the central line of the main slide 72a of such a forming stage 72 as mentioned above.

A holder block 77*d* is fixedly screwed to any desired position of the guide plate 77*b* by a screw extending through a slot 77*ba* formed therein, as illustrated in FIGS. 48 and 49. A support arm 77*e* is fixedly screwed to any desired position of the holder block 77*d* by a screw extending through a slot 77*da* formed therein, as illustrated in FIGS. 50 and 51. The support arm 77*e* is shorter than the support arm 75*c* of such linear way mechanism 75 as mentioned above, but a symmetrical one is likewise provided to hold and fix the spindle 75*f* fixed to the sliding unit 75*a*, while it is turned at a desired angle. On the other hand, the snap ring mechanism 76 is also screwable to the holder block 77*d*, but its support arm 77*f* is shorter than such support arm 76*a* as mentioned above. The same holds for other members and structures. In adjustment, the axis of the spindle 77*c* at the extreme end of the main arm 77*a* is first screwed on the axis of the coil of the coiled spring progressively fed to the stage thereof after being slid along the guide groove formed in the head 20 for attachment. Then, the spindle 77*c* is rotated at the extreme end of the main arm 77*a* to locate the guide plate 77*b* in parallel with the arm of the coiled spring to be formed, and is moved vertically to regulate its height. Subsequently, the spindle 77*c* is fixed in place by a bolt. Thereafter, the holder block 77*d* is moved along the slot 77*ba* in the guide plate 77*b* to a position at which the coiled spring is to be formed, and is screwed at a desired position by a screw extending through the slot 77*ba*. Finally, the support arm 77*e* is moved along the holder block 77*d*, and is regulated according to the diameter of the coil of the coiled spring for fixation.

Reference will now be made to the operation of the present coiled spring making apparatus of such a structure as mentioned in the foregoing.

In order to make the coiled springs with the coiled spring making apparatus according to the present invention, the coiling section on the framework 1 is first aligned with the progressive forming section according to the coiled springs to be formed, before the motor housed within the framework 1 providing a driving source is driven.

More specifically, the screw rod 3 for horizontal adjustment turnably fitted into the framework 1 is turned to move the support table 4 right- or left-handedly on the two rails 2 fixed onto the framework 1 and the screw rod 6 for transverse adjustment turnably fitted into the support table 4 is turned to move the main table 7 transversely on the two rails 5 fixed onto the support table 4, thus bringing the coiled portion of the coiled spring perfectly formed at the coiling section in coincidence with the grip of the pick-up unit 26 on standby on the first stage of the progressive forming section. In other words, the movable tables comprising the support table 4 and main table 7 are moved horizontally or transversely with respect to the framework 1 for alignment, whereby the coiled portion of the coiled spring formed at the coiling section is to be formed at a position coinciding with the grip of the pick-up unit 26 on standby on the first stage of the progressive forming section.

It is here to be understood that, before the movable tables comprising the support table 4 and main table 7 are moved horizontally or transversely with respect to the framework 1 to bring the coiled portion of the coiled section formed at the coiling section in coincidence with the grip of the pick-up unit 26 on standby on the first stage of the progressive forming section, it is required to previously adjust the power unit 8, feed roller drive unit 9, core bar adjusting mechanism 10, pitch tool operating mechanism 11, wire cutting mechanism 12, coil diameter adjusting mechanism 13 and bending die operating mechanism 14 according to the geometries and dimensions of the coiled springs to be produced.

While the power unit 8, feed roller drive unit 9, core bar adjusting mechanism 10, pitch tool operating mechanism 11, wire cutting mechanism 12, coil diameter adjusting mechanism 13 and bending die operating mechanism 14 are thus regulated according to the geometries and dimensions of the coiled springs to be produced, the movable tables are moved horizontally or transversely with respect to the framework 1. Afterwards, the power unit 8 is actuated to feed out a wire through the feed rollers 9*a* of the feed roller driving unit 9. The wire then moves past the wire guide 12*a* of the wire cutting mechanism 12 into engagement with the bending die 13*g* of the coil diameter adjusting mechanism 13, where it is successively coiled at the predetermined pitch and radius of curvature with the central axis of the coil being precisely kept vertical. The wire is subsequently cut off by the wire guide 12*a* of the wire cutting mechanism 12 and the core bar 10*a*. However, since the terminating end of the coiled spring is held between the front end face 26*ca* of the cartridge 26*c* of the pick-up unit 26 that is the grip means of the progressive forming section and the front end lug 26*eb* of the grip tool 26*e* during cutting, the end arms of the coiled spring are to be formed into the desired geometry at the progressive forming section.

More specifically, the coiled spring with the terminating end gripped by the pick-up unit 26 of the progressive forming section on the first stage is varied on the second stage in terms of its angle of gripping, if required, and is also gripped at the terminating end, if required. Then, the coiled spring is successively formed at its ends on the third and subsequent stages and finished on the seventh stage. Finally, the thus finished coiled spring is released from the eighth stage.

What is claimed is:

1. A coiled spring making apparatus comprising:

a coiling section for forming coiled springs; and a progressive forming section for receiving the coiled springs formed at said coiling section and feeding the coiled springs to a plurality of stages on which said coiled springs are held and successively formed into a desired shape;

said coiling section being a bending die system in which said coiled springs are formed with their axes in a vertical position and said coiling section is mounted on a movable table, said movable table comprising means for moving said table horizontally or transversely with respect to said progressive forming section to a desired position and fixing said table in said desired position, wherein said coiling section is aligned with said progressive forming section in accordance with the desired shape of the coiled springs.

2. A coiled spring making apparatus as claimed in claim 1, wherein said progressive forming section comprises means for holding the terminating is of the coiled springs formed at said coiling section for progressive feeding.

3. A coiled spring making apparatus as claimed in claim 1, wherein said progressive forming section comprises means for holding, on at least one of said plurality of stages, the terminating and leading ends of the coiled springs formed at said coiling section for progressive feeding.

4. A coiled spring making apparatus as claimed in claim 2 or 3, wherein said holding means of said progressive forming section comprises a separate grip member positioned on at least one of said plural stages to vary the angle of said coiled springs to be gripped with said separate grip member and, thereafter, said holding means holds said coiled spring for progressive feeding.

* * * * *